US010717313B2

(12) United States Patent
Schwendimann et al.

(10) Patent No.: US 10,717,313 B2
(45) Date of Patent: Jul. 21, 2020

(54) HEATED WRITING DEVICE FOR USE WITH THERMOCHROMATIC INK

(71) Applicant: NuCoat, Inc., Plymouth, MN (US)

(72) Inventors: Jodi A. Schwendimann, Wayzata, MN (US); Richard Maksimoski, Gahanna, OH (US)

(73) Assignee: NuCoat, Inc., Plymouth, MN (US)

( * ) Notice: Subject to any disclaimer, the term of this patent is extended or adjusted under 35 U.S.C. 154(b) by 539 days.

(21) Appl. No.: 15/082,001

(22) Filed: Mar. 28, 2016

(65) Prior Publication Data

US 2017/0274699 A1 Sep. 28, 2017

(51) Int. Cl.

| | |
|---|---|
| ***H05B 3/00*** | (2006.01) |
| ***B43K 8/22*** | (2006.01) |
| ***B43L 3/00*** | (2006.01) |
| ***B41M 5/26*** | (2006.01) |
| ***A63H 33/22*** | (2006.01) |

(52) U.S. Cl.

CPC ..... *B43K 8/22* (2013.01); *A63H 33/22* (2013.01); *B41M 5/26* (2013.01); *B43L 3/001* (2013.01); *H05B 3/0014* (2013.01)

(58) Field of Classification Search

CPC ..... H05B 3/0014; B43K 8/22; B41M 5/26; B43L 3/001

USPC ..... 219/229

See application file for complete search history.

(56) References Cited

U.S. PATENT DOCUMENTS 5,011,445 A 4/1991 Nakasuji et al.
5,157,011 A * 10/1992 Okabe ..... B41M 5/363 428/521
5,376,772 A * 12/1994 Nakagawa ..... A63H 33/22 219/221
5,441,418 A 8/1995 Brown et al.

(Continued)

FOREIGN PATENT DOCUMENTS

CN 105082828 11/2015
DE 202007006365 7/2007

(Continued)

OTHER PUBLICATIONS

U.S. Appl. No. 15/059,825, filed Mar. 3, 2016, Schwendimann et al.

(Continued)

*Primary Examiner* — Brian W Jennison
(74) *Attorney, Agent, or Firm* — Padda Law Group

(57) ABSTRACT

The present disclosure relates to a device for activating thermochromatic ink. The device may include a drawing tip, a heating element, which may include a positive temperature coefficient (PTC) heating element, communicably coupled to the drawing tip and configure to heat the drawing tip, and a power source configured to provide power to the heating element. The power source may be a lithium-ion battery. The battery may be rechargeable, and the device may have a charging port to recharge the battery from a power source coupled to the charging port. The device may have a regulator for regulating power from the power source to the heating element. The device may have a controller for directing power from the power source to the heating element. Further the heating element may be configured to heat the drawing tip to a temperature between 30-70 degrees Celsius.

23 Claims, 19 Drawing Sheets

(56) References Cited

U.S. PATENT DOCUMENTS 5,502,967 A * 4/1996 Nakagawa ..... B43K 8/22 219/216
5,514,635 A 5/1996 Filo
5,786,838 A * 7/1998 Steinhauser ..... B41M 5/282 347/179
6,040,559 A * 3/2000 Chou ..... B29C 65/18 219/228
6,281,165 B1 8/2001 Cranford
6,346,024 B1 * 2/2002 Engel ..... A63H 23/00 401/1
6,481,753 B2 11/2002 Van Boom et al.
6,545,671 B1 * 4/2003 Silverman ..... G06F 3/03545 345/179
6,594,927 B2 7/2003 Witkowski
7,144,289 B2 12/2006 Murasko et al.
7,494,537 B2 2/2009 Ono et al.
7,691,458 B2 4/2010 Brist et al.
8,033,705 B2 10/2011 Forrester et al.
8,325,416 B2 12/2012 Lesage et al.
8,662,893 B2 3/2014 Schwendimann et al.
9,573,403 B1 * 2/2017 Nasser ..... B44D 2/002
2005/0165131 A1 7/2005 Stovold
2008/0050540 A1 2/2008 Christofer et al.
2008/0298878 A1 * 12/2008 Hui ..... B43K 5/17 401/108
2010/0264640 A1 10/2010 Lane et al.
2011/0212421 A1 * 9/2011 Schwendimann ..... B42D 15/00 434/85
2013/0075385 A1 * 3/2013 Rosen ..... B43L 19/00 219/233
2013/0327755 A1 * 12/2013 Weiss ..... B23K 9/0216 219/138
2014/0213442 A1 * 7/2014 Clayton ..... B41M 5/305 503/201
2014/0283825 A1 * 9/2014 Buchberger ..... A61M 11/041 128/202.21

FOREIGN PATENT DOCUMENTS

JP 2015101087 6/2015
WO 2008079357 7/2008
WO 2015046257 4/2015

OTHER PUBLICATIONS

U.S. Appl. No. 15/060,066, filed Mar. 3, 2016, Schwendimann et al.

* cited by examiner

HEATED WRITING DEVICE FOR USE WITH THERMOCHROMATIC INK

FIELD OF THE INVENTION

The present application is generally directed to writing devices. Particularly, the present application relates to writing devices for use with thermochromatic ink. More particularly, the present application relates to heated writing devices that may be used to activate thermochromatic ink.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Thermochromatic inks are inks that change color in reaction to temperatures. They can be formulated such that they change from any color to any color, including turning from opaque or translucent colors, or turning to opaque from translucent colors, in reaction to a temperature change. They can be formulated such that they change colors at a variety of temperatures, such that a particular formulation can have several different temperature transition points or ranges, each with a particular color change from one particular color to another. They can be mixed with non-thermochromatic inks, such that blending of a constant color of the non-thermochromatic ink with the temperature-dependent color of a thermochromatic ink occurs.

Toys benefit people in both the educational process and in providing amusement. This is particularly so in the case of children, because they need stimulation to develop their minds and to expend their energy. Toys that have interesting colors or other properties can be fun or educational. For example, devices that allow one to make and show drawn images are useful as toys, as drawing tools for people of any age, and for commercial applications such as showing the day's menu in a restaurant setting. Coloring and drawing is a creative and satisfying activity for both adults and children.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a device for activating thermochromatic ink. The device may include a drawing tip, a heating element, which may include a positive temperature coefficient (PTC) heating element, communicably coupled to the drawing tip and configured to heat the drawing tip, and a power source configured to provide power to the heating element. The power source may be a lithium-ion battery in some embodiments. The battery may be rechargeable, and the device may have a charging port to recharge the battery from a power source coupled to the charging port in some embodiments. In some embodiments, the device may have a regulator for regulating power from the power source to the heating element. The device may have a controller for directing heat from the power source to the heating element. In some embodiments, the device may have a heat sensor communicably coupled to the controller and configured to sense a temperature of the drawing tip and/or heating element. The drawing tip may have a cavity, and the heating element may be arranged within the cavity in some embodiments. Further the heating element may be configured to heat the drawing tip to a temperature between 30-70 degrees Celsius in some embodiments.

The present disclosure, in one or more additional embodiments, relates to a thermochromatic drawing system. The system may have a work surface configured to provide a support for a substrate, wherein the substrate is treated with a thermochromatic ink. The system may additionally have a device for activating thermochromatic ink. The device may have a drawing tip, a heating element, which may include a positive temperature coefficient (PTC) heating element, communicably coupled to the drawing tip and configured to heat the drawing tip, and a power source configured to provide power to the heating element. In some embodiments, the system may include a frame or clip for holding the substrate against the work surface. The work surface may also have a carrying handle. The power source of the device may be a lithium-ion battery, and the battery may be rechargeable in some embodiments. In some embodiments, the work surface may have a light. The work surface may have a storage unit for storing the substrate. Moreover, the substrate may be a sheet of paper treated with one or more thermochromatic inks.

The present disclosure, in one or more additional embodiments, relates to a device for activating thermochromatic ink. The device may include a drawing tip having a cavity, a heating element arranged within the cavity, the heating element communicably coupled to the drawing tip and configured to heat the drawing tip, and a power source configured to provide power to the heating element. The power source may be a lithium-ion battery in some embodiments. The device may further include a spring and spring retention member. The spring may be held within the drawing tip cavity between the heating element and the spring retention member, such that the spring and spring retention member provide a retention force to hold the heating element against the drawing tip.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1:
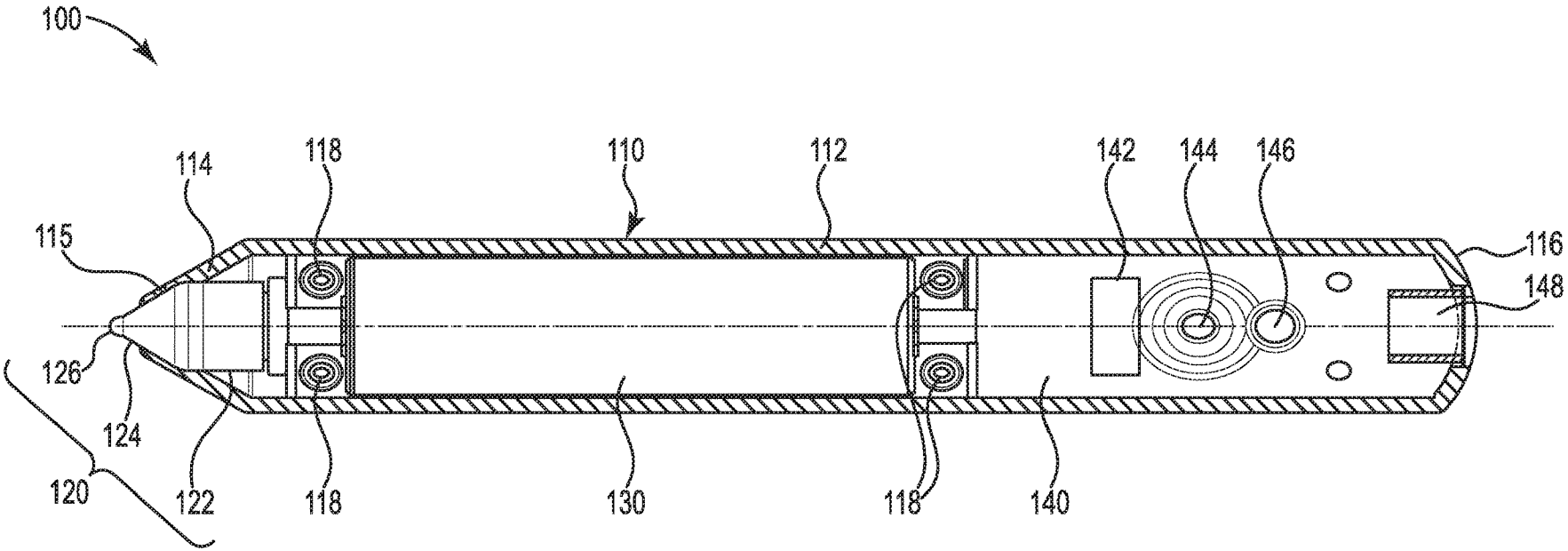
FIG. 1 is an internal view of a heated pen of the present disclosure, according to one or more embodiments.

The present disclosure relates to writing devices, utensils, or wands for use with thermochromatic ink. Particularly, in some embodiments, the present disclosure relates to heated pens for writing, drawing, coloring, or otherwise interacting with a surface treated with thermochromatic ink. When used to write, draw, color, or otherwise interact with the surface, the heated pen may active the thermochromatic ink. The heated pen may have a drawing tip configured for interacting with the surface having thermochromatic ink. The drawing tip may be heated during use, such that the drawing tip may activate the thermochromatic ink. The heated drawing tip may cause the thermochromatic ink to change colors. In general, a heated pen of the present disclosure may have a heating element, such as a positive temperature coefficient (PTC) heater. Additionally, in some embodiments, a heated pen of the present disclosure may have a power source, such as a lithium ion battery or other battery.

Heated writing devices may generally be heated by various means. Some heated writing devices may be heated using a simple resistor circuit having one or more resistors or resistor wire. However, in some cases, such resistance heaters may present difficulties in heating to a particular temperature in a relatively short amount of time and/or maintaining a particular temperature. As a result, heated writing devices having such resistance heaters may be generally inefficient in some applications. For example, where a heated pen having a simple resistance heater is used to activate thermochromatic ink on a surface, thermal energy from the heated pen may transfer to the surface, and the heated pen may cool such that it stops activating the thermochromatic ink. A user of the pen may then be required to wait until the pen reheats before it can be used to activate the thermochromatic ink again. In some cases, the temperature of such a resistor-heated pen may decline relatively quickly once the pen comes in contact with the surface.

Turning now to FIGS. 1 and 2, a heated pen 100 according to some embodiments of the present disclosure is shown. The heated pen 100 may be configured to interact with a thermochromatic element, such as thermochromatic ink. Particularly, the heated pen 100 may be configured for writing, drawing, or coloring on a surface or substrate, such as a sheet of paper or plastic, treated with thermochromatic ink. In some embodiments, as shown for example in FIG. 1, the heated pen 100 may generally be configured to appear like a pen, pencil, marker, crayon, or other conventional writing utensil. In other embodiments, the heated pen 100 may have other configurations or designs. In some embodiments, the heated pen 100 may be battery powered and/or rechargeable. In other embodiments, the heated pen 100 may be powered by other means. The heated pen 100 may have a body 110 housing a heated tip 120 coupled to a heating element 150, a battery 130, a controller 142, a switch 144, an indicator light 146, and a charging port 148. In some embodiments, the controller 142, switch 144, indicator light 146, and charging port 148 or various subsets thereof may be electrically connected via a circuit board 140, such as a printed circuit board.

The body 110 of the heated pen 100 may be configured to house electrical and/or other components. Additionally, the body 110 may provide a gripping location for a user to grip or hold the heated pen 100 during use. In some embodiments, the body 110 may be constructed of plastic, such as acrylonitrile butadiene styrene (ABS) plastic or other plastics. In other embodiments, the body 110 may be constructed of any suitable material or materials. The body may have an elongated portion 112 extending between a first end 114 and a second end 116.

The elongated portion 112 may have a generally cylindrical shape in some embodiments. For example, the elongated portion 112 may have a circular or generally circular cross section extending between a first end 114 and a second end 116. In other embodiments, the elongated portion 112 may have any suitable cross sectional shape. The elongated portion 112 may have a diameter or width of between 1 and 30 centimeters in some embodiments. Particularly, the elongated portion 112 may have a diameter or width of between 5 and 25 centimeters in some embodiments. More particularly, in some embodiments, the elongated portion 112 may have a diameter or width of between 5 and 20 centimeters. In other embodiments, the elongated portion 112 may have any suitable diameter or width. The width or diameter of the elongated portion 112 may be substantially constant for all or most of the length between the first end 114 and second end 116 in some embodiments. In other embodiments, the elongated portion 112 may have variations in the diameter or width between the first end 114 and second end 116. The length of the elongated portion 112 extending between the first end 114 and second end 116 may be between 20 and 200 centimeters in some embodiments. Particularly, the elongated portion 112 may have a length of between 50 and 150 centimeters in some embodiments. More particularly, in some embodiments, the elongated portion 112 may have a length of between 100 and 125 centimeters. In other embodiments, the elongated portion 112 may have any suitable length.

Figure 2A:
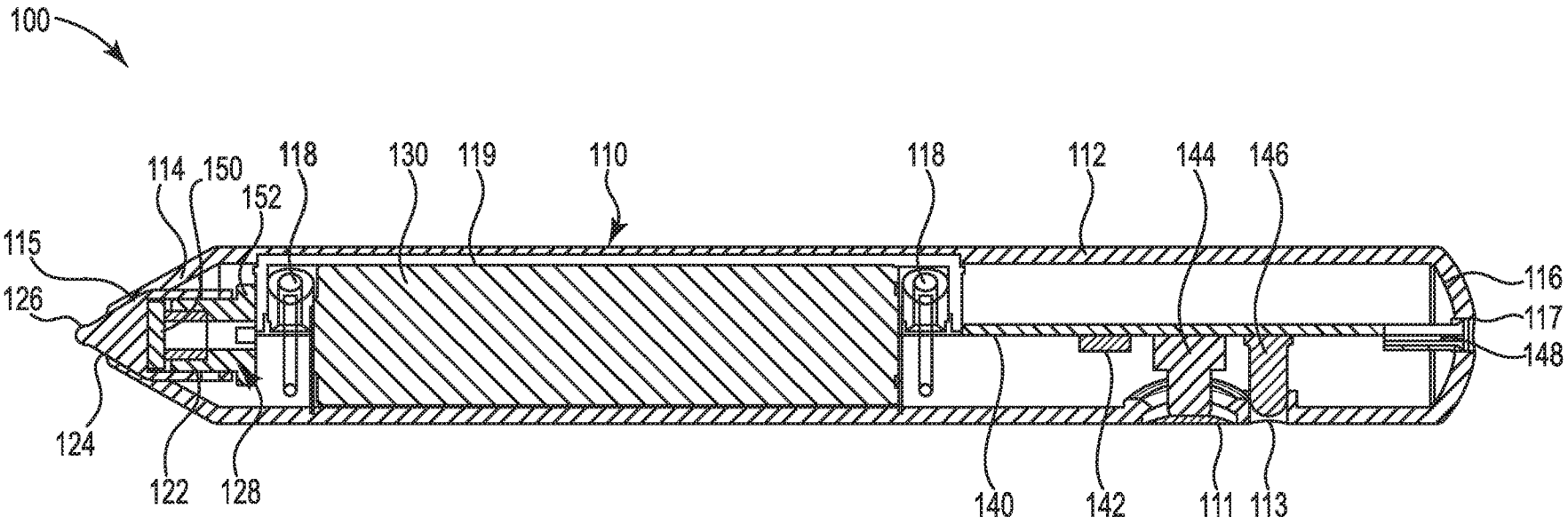
FIG. 2A is a cross sectional view of the heated pen of FIG. 1, according to one or more embodiments.

In some embodiments, the elongated portion 112 may include multiple components coupled together. For example, in some embodiments, the elongated portion 112 may be constructed of two halves, each half spanning the full length of the elongated portion and having a semi-circular or other suitably shaped cross section. The two halves may be coupled via one or more screws, bolts, friction-fitting components, or pins 118, as shown in FIGS. 1 and 2A. For example, four pins 118 may be used to couple the two halves of the elongated portion 112. In other embodiments, any suitable number of screws, bolts, friction-fitting components, or pins may be used to couple the two or more sections of the elongated portion 112. In other embodiments, the two or more sections of the elongated portion 112 may be coupled using glue, a tongue and groove mechanism, or any other suitable coupling mechanism. In other embodiments, the elongated portion 112 may be constructed as a single component, such as a single plastic component.

In some embodiments, the elongated portion 112 may have a grip, such as a padded plastic or foam grip to allow for a user to better grip or hold the heated pen 100. Further, in some embodiments, the elongated portion 112 may have ergonomic features or design elements to allow for ease of use. In still further embodiments, the elongated portion 112 may have other design elements or features.

The elongated portion 112 may have one or more openings 111, 113 in some embodiments. The opening 111 may allow a user to access a switch 144 to activate or control electronics within the pen 100, for example. The opening 113 may allow an indicator light 146 to be displayed, for example. Each of the openings 111, 113 may be sized for their associated components (i.e. the switch and the indicator light). The openings 111, 113 may each be arranged on the elongated portion 112 nearest the second end 116 in some embodiments, so as to allow a user to hold or use the pen 100 without interfering with or covering the switch 144 or indicator light 146. In other embodiments, the openings 111, 113 may be arranged in a different location on the body 110.

The first end 114 of the body 110 may be arranged substantially near the heated tip 120. Particularly, in some embodiments, the first end 114 may be arranged about the heated tip 120, as shown in FIGS. 1 and 2. The first end 114 may couple to the elongated portion 112 via glue, threading, one or more screws, or other methods. In some embodiments, the first end 114 may snap onto the elongated portion via a tongue and groove, friction fit, or other mechanism. In still other embodiments, at least a portion of the first end 114 may be constructed with at least a portion of the elongated portion 112 as a single component, such as a single integrated plastic component. In some embodiments, the first end 114 may taper or narrow as it extends from the elongated portion 112. For example, the first end 114 may have a generally conical shape in some embodiments, with a widest portion of the first end arranged nearest the elongated portion 112. From the elongated portion 112, the conically shaped first end 114 may narrow or taper to an opening 115. The opening 115 may be configured to allow a portion of the heated tip 120 to pass through and extend outward from the body 110. At its widest point nearest the elongated portion 112, the first end 114 may have a width or diameter substantially the same as, or similar to, that of the elongated portion. For example, the widest point of the first end 114 may have a width or diameter of between 5 and 20 centimeters in some embodiments. At its narrowest point, where the opening 115 is arranged, the first end 114 may have a width or diameter of less than 1 and up to about 10 centimeters in some embodiments. In other embodiments, the first end 114 may have any suitable width(s) or diameter(s). It is also appreciated that the first end 114 may have any suitable shape, other than a conical shape, in other embodiments.

The opening 115 may generally have any suitable shape configured to receive the heated tip 120. In some embodiments, for example, the opening 115 may be a circular opening. The opening 115 may have a width or diameter of less than 1 and up to about 10 centimeters in some embodiments. In other embodiments, the opening 115 may have any suitable width or diameter.

The second end 116 may be arranged on the elongated portion 112, opposite the first end 114. The second end 116 may couple to the elongated portion 112 via glue, threading, one or more screws, friction fit, or other methods. In some embodiments, the second end 116 may snap onto the elongated portion via a tongue and groove or other mechanism. In still other embodiments, at least a portion of the second end 116 may be constructed with at least a portion of the elongated portion 112 as a single component, such as a single integrated plastic component. In some embodiments, the second end 116 may extend from the elongated portion 112 with a domed or curved shape. In other embodiments, the second end 116 may have any suitable shape or configuration. The second end 116 may have an opening 117 in some embodiments. The opening 117 may be configured to allow access to a USB or mini USB port or other electrical port, as will be described below. The opening 117 may generally be sized to receive a USB, mini USB, or other electrical plug. In other embodiments, the second end 116 may be a closed end. In some embodiments, the opening 117 and corresponding electrical port may be arranged at a different location on the body 110.

As shown in FIGS. 1 and 2A, the body 110 may generally be hollow, such that it may house the heated tip 120, battery 130, circuit board 140, and/or other components. In some embodiments, the body 110 may have a constant or substantially constant thickness. The body 110 may have a thickness of between 5 and 50 millimeters in some embodiments. In other embodiments, the body 110 may have any suitable thickness. In some embodiments, the thickness of the body 110 may vary. For example, as shown in FIG. 2A, the thickness of the body 110 may narrow about the heated tip 120. In some embodiments, the body 110 may include or house a structure 119 configured to physically and/or electrically couple the circuitry of the printed circuit board 140 with the heating element 150. For example, the structure 119 may extend from the circuit board 140, around the battery 130, and extend at an opposing end from the heating element 150. In some embodiments, the structure 119 may be coupled to or incorporated in the body 110. For example, the structure 119 may be incorporated into a sidewall of the body 110.

The heated tip 120 may be arranged partially or substantially within the body 110 nearest the first end 114. At least a portion of the heated tip 120 may extend through the opening 115 of the body 110. The heated tip 120 may be constructed of metal or other suitable conductive material(s). In some embodiments, the heated tip 120 may have a rubber coating or other coating over at least a portion of the heated tip. The heated tip 120 may have any suitable shape. As shown in FIG. 1, for example, the heated tip 120 may have a cylindrical portion 122 and a conical portion 124.

The cylindrical portion 122 may be positioned within the body 110 in some embodiments. The cylindrical portion 122 may generally have a round cross sectional shape, having any suitable width or diameter. In some embodiments, for example, the cylindrical portion 122 may have a width or diameter of between about 0.5 and 10 centimeters. The cylindrical portion 122 may additionally have any suitable length. For example, the cylindrical portion 122 may have a length of between 1 and 10 centimeters in some embodiments. The cylindrical portion 122 may have a cavity 128 or hollow portion configured to receive the heating element 150 in some embodiments. The cavity 128 may extend into the cylindrical portion 122 from a side opposite that of the conical portion 124. The cavity 128 may have a cylindrical shape in some embodiments, and may have any suitable diameter or width smaller than that of the cylindrical portion. In other embodiments, the cavity 128 may have any suitable shape and size configured to receive the heating element 150. In other embodiments, the cylindrical portion 122 may be solid or substantially solid, and the heating element 150 may be attached to the cylindrical portion.

The conical portion 124 of the heated tip 120 may extend from the cylindrical portion 122. The conical portion 124 may have a length of between about 0.5 and 10 centimeters in some embodiments. In other embodiments, the conical portion 124 may have any suitable length. At a widest portion of the conical portion 124, such as where the conical portion extends from the cylindrical portion 122, the conical portion may have a diameter or width substantially the same or similar to that of the cylindrical portion. For example, in some embodiments, the conical portion 122 may have a widest diameter or width of between about 0.5 and 10 centimeters. At a narrowest portion, the conical portion 124 may have a diameter or width of less than 1 and up to about 5 centimeters in some embodiments. In other embodiments, the conical portion 124 may have any suitable widest and narrowest widths. Moreover, the conical portion 124 may have an internal angle formed between opposing sides of the conical shape of between about 10 and 100 degrees in some embodiments. Particularly, the conical portion 124 may have an internal angle of between about 50 and 80 degrees in some embodiments. In other embodiments, the conical portion 124 may have any suitable internal angle. The conical portion 124 may extend through the opening 115 of the body 110. The conical portion 124 may extend a length of less than 1 and up to about 5 centimeters outside of the body 110 in some embodiments. In other embodiments, the conical portion 124 may extend any suitable length from the body 110. In some embodiments, the conical portion 124 may have a rounded point 126 arranged at the narrowest portion of the conical shape. The rounded point 126 may extend from the conical portion 124 and may have a generally semi-spherical shape. The rounded point 126 may have a diameter or width of between about 0.1 and 5 centimeters in some embodiments. In other embodiments, the rounded point 126 may have any suitable diameter or width. The rounded point 126 may allow a user to hold the pen 100 at various angles while maintaining contact with a surface, such as a writing surface. In this way, the heated tip 120 may generally be configured to be pulled, drawn, or otherwise moved across a surface, such that a user may draw, write, or color with the heated pen 100 on thermochromatic paper, for example. It may be appreciated that the rounded tip 126 may allow a user to write, draw, color, or otherwise use the heated pen 100 at angles ranging from 90 to 45 degrees between a longitudinal axis of the pen 100 and a writing surface. In other embodiments, the pen 100 may be used at angles of less than 45 degrees between the longitudinal axis of the pen and the writing surface.

Figure 3B:
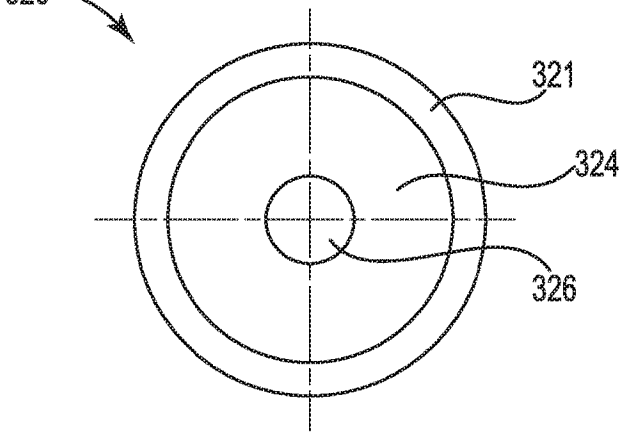
FIG. 3B is an end view of the heated tip of FIG. 3A, according to one or more embodiments.
Figure 3A:
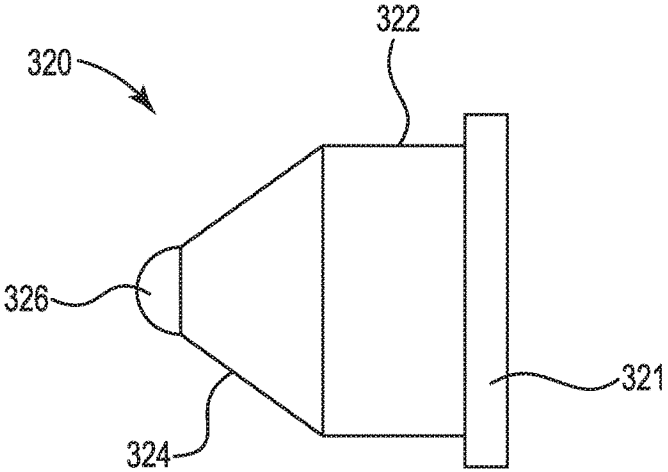
FIG. 3A is a side view of a heated tip of the present disclosure, according to one or more embodiments.
Figure 3C:
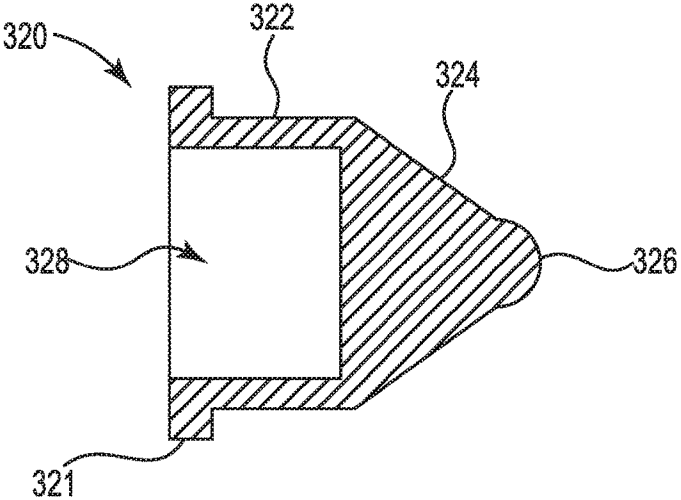
FIG. 3C is a cross sectional view of the heated tip of FIG. 3A, according to one or more embodiments.

FIGS. 3A-3C illustrate another embodiment of a heated tip 320. Similar to heated tip 120, the heated tip 320 may have a cylindrical portion 322, a conical portion 324, a rounded point 326, and a cavity 328. As shown in FIGS. 3A and 3C, the heated tip 320 may additionally have a collar portion 321 in some embodiments. The collar portion 321 may extend from the cylindrical portion 322 on an opposing side from the conical portion 324. The collar portion 321 may have a circular cross section, similar to the cylindrical portion 322 for example. However, the collar portion 321 may have a diameter or width larger than that of the cylindrical portion 322 in some embodiments. The cavity 328 may extend through the collar portion 321 and into the cylindrical portion 322 in some embodiments.

Figure 4B:
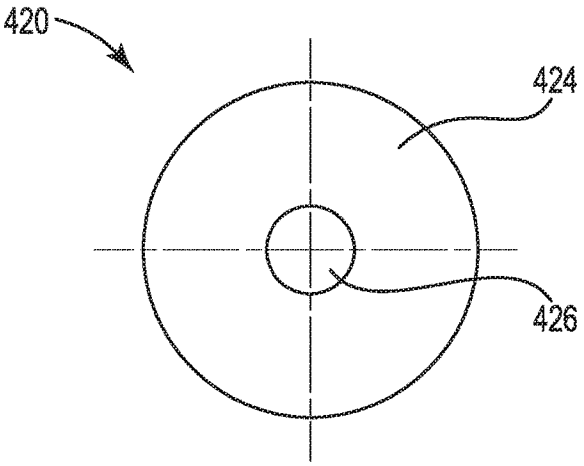
FIG. 4B is an end view of the heated tip of FIG. 4A, according to one or more embodiments.
Figure 4C:
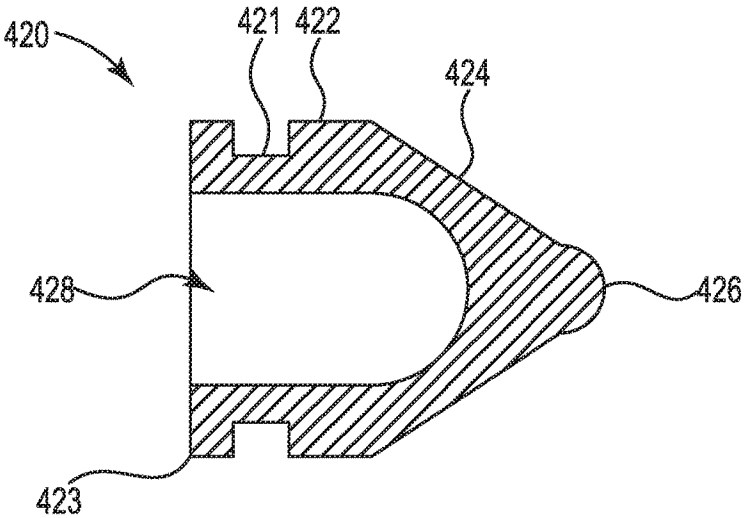
FIG. 4C is a cross sectional view of the heated tip of FIG. 4A, according to one or more embodiments.
Figure 4A:
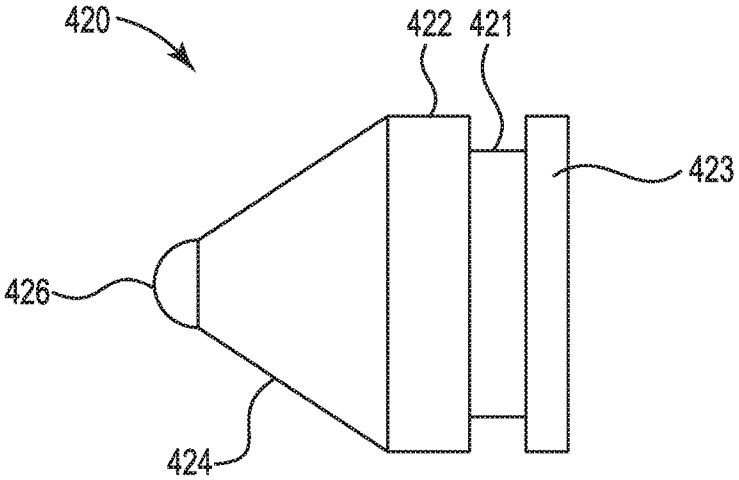
FIG. 4A is a side view of a heated tip of the present disclosure, according to one or more embodiments.

FIGS. 4A-4C illustrate yet another embodiment of a heated tip 420. Similar to heated tips 120 and 320, the heated tip 420 may have a cylindrical portion 422, a conical portion 424, a rounded point 426, and a cavity 428. As shown in FIGS. 4A and 4C, the heated tip 420 may additionally have a first collar portion 421 and a second collar portion 423. The first collar portion 421 may extend from the cylindrical portion 422 on an opposing side from the conical portion 424. The second collar portion 423 may extend from the first collar portion 421 on a side opposite the cylindrical portion 422. The first collar portion 421 and second collar portion 423 may each have a circular cross section in some embodiments. The first collar portion 421 may have a diameter or width smaller than that of the cylindrical portion 422, and the second collar portion 423 may have a diameter or width substantially the same or similar to that of the cylindrical portion in some embodiments. In other embodiments, the first 421 and second 423 collar portions may each have any suitable diameters or widths. Together, the collars 421, 423 may form a recession and lip at or near the end of the heated tip 420 opposite the conical portion 424. It is appreciated that other embodiments of heated tips of the present disclosure may have any of the collar portions discussed with respect to FIGS. 3 and 4. The one or more collar portions may facilitate positioning of the heated tip with the body of the pen. As additionally shown in FIG. 4C, in some embodiments, the cavity 428 may extend through the first 421 and second 423 collar portions, through the cylindrical portion 422, and into the conical portion 424. Additionally, the cavity 428 may have a rounded inner surface in some embodiments. It is appreciated that other embodiments of heated tips of the present disclosure may have a cavity extending into the conical portion and/or having a rounded inner surface as well.

Referring back to FIG. 2A, the heating element 150 may be configured to heat the heated tip 120. In some embodiments, the heating element 150 may be positioned within or partially within the heated tip 120. For example, as shown in FIG. 2A, the heating element 150 may be positioned within the cavity 128 of the heated tip 120. A retaining member 152 may be configured to secure the heating element 150 in position against or in thermal communication with the heated tip 120. The heating element 150 may have any suitable size and shape. In some embodiments, as shown in FIG. 2A, the heating element 150 may have a circular disk shape, for example. In other embodiments, the heating element 150 may have any suitable shape. The heating element 150 may generally have a size and shape configured to be positioned within the cavity 128 of the heated tip 120, and sufficient to provide a desired temperature or temperature range for the heated tip.

The heating element 150 may employ any suitable means to heat the heated tip 120. In some embodiments, the heating element 150 may be or include a ceramic PTC heating element. A PTC heating element may provide particular benefits. For example, a PTC heating element may provide for a relatively fast heat up time. That is, a PTC heating element may reach a desired or predetermined temperature within a relatively short amount of time, as compared with other heating elements. A PTC heating element may further provide for a relatively safe heating environment with a reduced risk of overheating. Particularly, that is, once a PTC heating element reaches a desired or predetermined temperature or temperature range, the heat output may decrease, such that the heating element, and in this case the heated tip 120, may be maintained at the desired or predetermined temperature or within the desired temperature range without becoming significantly hotter than the desired or predetermined temperature or range. Moreover, a PTC heating element may be capable of maintaining a desired or predetermined temperature or temperature range more effectively and/or efficiently than other heating elements. Particularly, in the context of the heated pen 100, where contact between the heated tip 120 and a surface, such as thermochromatic writing surface, may tend to reduce the temperature of the heated tip as heat transfers from the heated tip to the surface, a PTC heating element 150 may effectively or efficiently maintain heat flow to the heated tip in response, so as to help prevent the heated tip from dropping below a desired or predetermined temperature or range. In this way, it may be appreciated that a PTC heating element may be particularly effective for use in the heated pen. However, additional or alternative heating elements are contemplated as well. For example, the heating element 150 may be or include a cold heat soldering gun.

In some embodiments, the heating element 150 and/or heated tip 120 may be configured to maintain a particular temperature or temperature range during operation. For example, heating element 150 and/or heated tip 120 may be configured to operate at a temperature or temperature range that may be hot enough to interact with thermochromatic ink but not so hot as to easily burn skin or paper. In some embodiments, the heating element 150 and/or heated tip 120 may be configured to maintain a temperature of between 1 and 100 degrees Celsius. Particularly, the heating element 150 and/or heated tip 120 may be configured to maintain a temperature of between about 30 and 70 degrees Celsius in some embodiments. More particularly, in some embodiments, the heating element 150 and/or heated tip 120 may be configured to maintain a temperature of between about 45 and 55 degrees Celsius. In other embodiments, the heating element 150 and/or heated tip 120 may be configured to operate at any suitable temperature. In some embodiments, the heating element 150 and/or heated tip 120 may be configured to operate at multiple temperatures or temperature ranges, for example so as to correspond with different thermochromatic inks. In such embodiments, the heated pen 100 may have a switch, dial, or other mechanism to facilitate switching between the multiple operating temperatures or temperature ranges.

Referring back to FIGS. 1 and 2A, the heated pen 100 may have a battery 130. The battery 130 may be any suitable battery type, such as a dry cell battery or lithium-ion battery, for example. The battery 130 may be rechargeable in some embodiments. In some embodiments, the heated pen 100 may have more than one battery 130.

In some embodiments, a lithium-ion battery may provide particular benefits. For example, a lithium-ion battery may provide a particular energy density in a smaller battery and/or lower number of batteries than would be needed to achieve the same energy density using dry cell batteries. Tests were performed to determine whether use of a lithium-ion battery may provide advantages for the heating pen 100 over the use of some dry cell batteries. Particularly, the testing compared the performance of: (1) a single 14500 lithium-ion battery in a heating pen of the present disclosure; (2) two AA dry cell batteries in a heating pen of the present disclosure; and (3) two AAA dry cell batteries in a heating pen of the present disclosure, each of which are suitable and possible example embodiments of the present disclosure. The same heating pen was used for testing each of the three battery types. For each test, the heating pen was powered on using the battery(ies) and permitted to run continuously at a desired operating temperature range of between 50 and 55 degrees Celsius. The time needed for the heated tip of the pen to reach the operating temperature ("Start Up Time to 50° C.") and length of time for which the operating temperature could be maintained at the heated tip ("Continuous Run-Time") were measured. Results for the testing are shown in the table below.

| | | | | Results | | |
|---|---|---|---|---|---|---|
| Power Source | Ambient Temp (° C.) | Supply Voltage (V) | Capacity (A) | Start Up Time to 50° C. (s) | Continous Run-Time (min) | Operating Temp (° C.) |
| AA × 2 | 30.3 | 3.3 | | 20 | 190 | 54.0-54.3 |
| AAA × 2 | 29 | 3.3 | | 37 | 80 | 54.0-54.3 |
| Li-Ion 14500 × 1 | 28.7 | 3.7 | 700 mAh | 10 | 380 | 55 |

As may be appreciated from the results shown above, the single lithium-ion 14500 battery allowed the heated tip to reach the desired temperature range within a shorter amount of time (10 seconds), as compared with the two AA batteries (20 seconds) and the two AAA batteries (37 seconds). Moreover, the lithium-ion battery provided for a substantially longer run-time (380 minutes) at the desired temperature range, as compared with the AA (190 minutes) and AAA batteries (80 minutes). Additionally, during testing, the heated pens powered by the AA and AAA batteries were switched off when the batteries reached a voltage level of approximately 2.7 V. The heated tips were permitted to cool, and the heated pens were then switched back on. For each of the pens powered by the AA and AAA batteries, after the voltage dropped to 2.7 V, the start up time needed for the heated tip to reach 50° C. exceeded two minutes. Thus, it may be appreciated that the dry cell batteries may become less efficient or effective at powering the heated pen as their voltage reduces over time. Accordingly it may be appreciated that one or more lithium-ion batteries may be particularly effective or efficient for powering a heated pen of the present disclosure. However, additional or alternative battery types may be used as well, including dry cell batteries in some embodiments. In still other embodiments, the heated pen 100 may be powered by other components, such as a power cord connected to an AC power supply, such as a home wall outlet, for example. Still other suitable power sources are usable as well.

With continued reference to FIGS. 1 and 2A, the controller 142 may generally be configured to receive, store, and/or send instructions. The controller 142 may control the heating element 150 and/or direct power from the battery 130 to the heating element. For example, the controller 142 may control energy flow to the heating element 130 so as to maintain a desired or predetermined temperature or temperature range at the heated tip 120. The controller 142 may additionally or alternatively control other elements. For example, the controller 142 may control operation of the indicator light 146. In some embodiments, the controller 142 may include a regulator, such as a voltage regulator. The voltage regulator may be configured to maintain a constant or near constant voltage to the heating element 120 from the battery 130.

In some embodiments, a heated pen of the present disclosure may have a temperature sensor. The temperature sensor may be arranged on or near the heated tip 120 and/or heating element 150. The temperature sensor may be configured to measure a temperature of the heated tip 120 and/or heating element 150. The temperature sensor may be electrically coupled to the controller 142 and may be configured to provide the controller with the measured temperature data. In some embodiments, the controller 142 may adjust energy being supplied to the heating element 150 based on temperature data received from the temperature sensor. The temperature sensor may be configured to send temperature information to the controller 142 at random or periodic intervals or continuously or substantially continuously, for example.

The switch 144 may extend from the circuit board 140, and may generally be accessible to a user, such as through the opening 111 in the body 110. The switch 144 may provide one or more controls for the pen 100. In some embodiments, the switch 144 may be a power switch, allowing a user to turn the pen on and off. In other embodiments, the switch 144 may provide additional or alternative controls or settings, such as a timer, temperature control, or other controls or settings. The switch 144 may be arranged on the body 110, such as on the elongated portion 112. The switch 144 may be located nearest the second end 116 in some embodiments, such that a user may be able to hold and use the pen 100 without interfering with the switch. The switch 144 may be or include any suitable type of switch mechanism. For example, the switch 144 may be or include a push button, a toggle switch, a slide switch, a control dial, or any other suitable switch mechanism. The heated pen 100 may have multiple switches or other controls in some embodiments.

The indicator light 146 may extend from the circuit board 140 and may generally be visible to a user, such as through the opening 113 of the body 110. The indicator light 146 may be configured to provide an indication to a user. For example, the indicator light 146 may be configured to light up when the heated pen 100 is powered on. In other embodiments, the light 146 may provide an indication of various levels of battery life and/or charging states. In still other embodiments, the light 146 may provide a warning, such as a temperature warning, for example. The indicator light 146 may be arranged on the body 110, such as on the elongated portion 112. The indicator light 146 may be located nearest a second end 116 in some embodiments, such that a user may be able to view the indicator light while holding or using the pen 100. The indicator light 146 may be or include any suitable type of light-up device, such as an LED light for example. In some embodiments, the heated pen 100 may have multiple indicator lights 146 to indicate various information.

A charging port 148 or other electrical port may extend from the circuit board 140 and may generally be accessible by a user. The charging port 148 may be configured to provide a means for charging or recharging the battery 130. In some embodiments, the charging port 148 may be a USB port or mini USB port configured to receive a USB or mini USB plug coupled to the battery 130, for example. In other embodiments, the charging port 148 may be or include any suitable style or configuration. In other embodiments, the battery 130 may be charged or recharged using other means, including other wired or wireless charging methods.

Figure 2B:
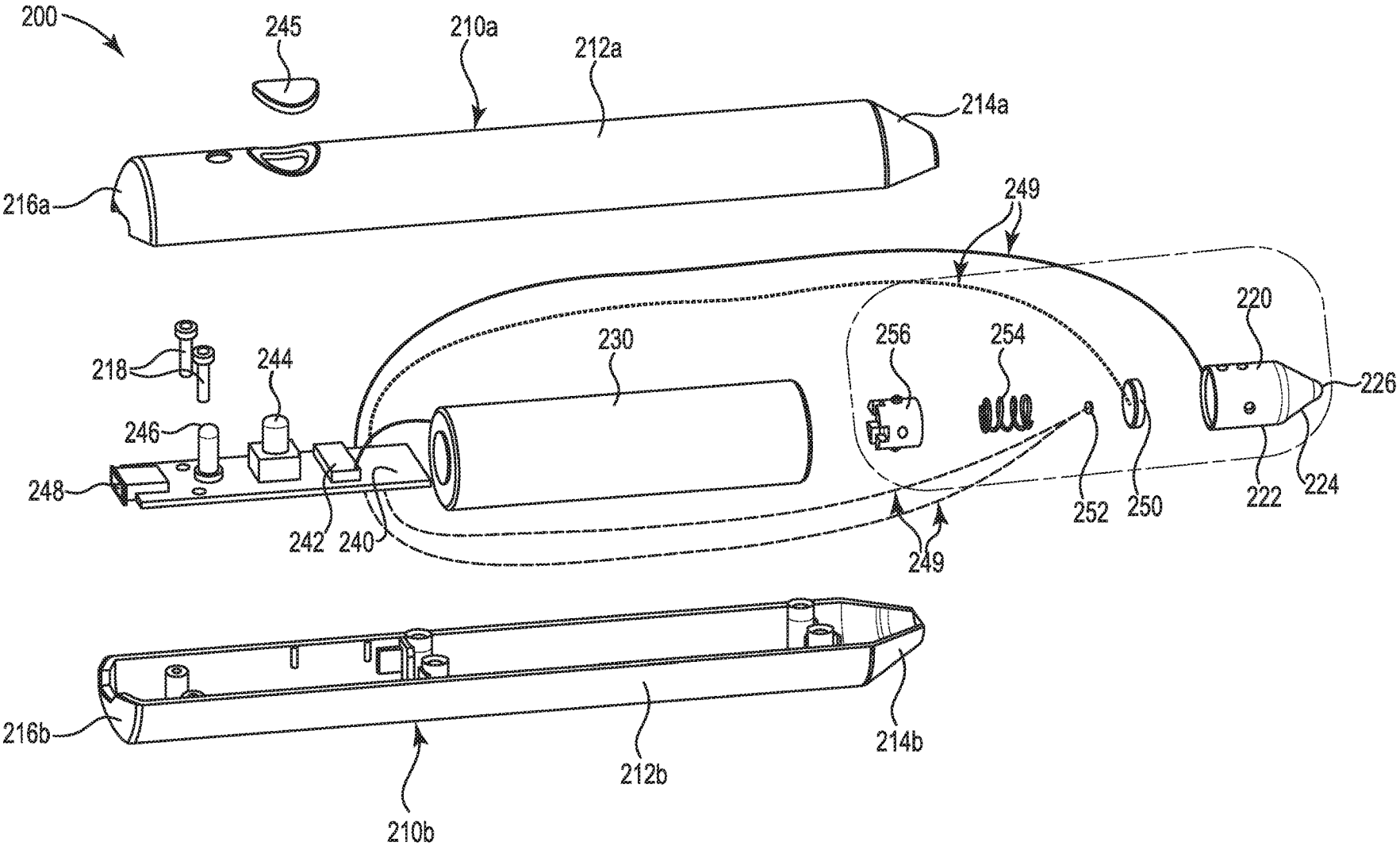
FIG. 2B is an exploded view of another heated pen of the present disclosure, according to one or more embodiments.

Turning now to FIG. 2B, another embodiment of a heated pen 200 of the present disclosure is shown. Particularly, FIG. 2B illustrates an exploded view of the heated pen 200. As shown, the heated pen 200 may have a body 210 housing a heated tip 220, a battery 230, a controller 242, a switch 244, an indicator light 246, and a charging port 248. The controller 242, switch 244, indicator light 246, and charging port 248 or various subsets thereof may be electrically connected via a circuit board 240, such as a printed circuit board, and/or one or more leads or wires 249.

Similar to the body 110 described above, the body 210 may have an elongated portion 212, a first end 214, and a second end 216. Moreover, the body 210 may be comprised of two components 210*a*, 210*b* coupled together by a plurality of pins 218. Each component 210*a*, 210*b* may have, for example, a portion of each of the elongated portion 212*a*, 212*b*, first end 214*a*, 214*b*, and second end 216*a*, 216*b*.

The battery 230, controller 242, switch 244, indicator light, 246, charging port 248, and circuit board 240 may be similar to those described above with respect to FIGS. 1 and 2A. The battery 230 may be in electrical communication with the circuit board 240 and/or controller 242 via one or more leads or wires 249 in some embodiments.

In some embodiments, the heated pen 200 may have a switch cover 245 positioned over the switch 244. The switch cover 245 may provide for easier pushing of the switch 244, where the switch is a push button for example, or may slide or flip open to provide access to the switch in other embodiments.

Figure 2C:
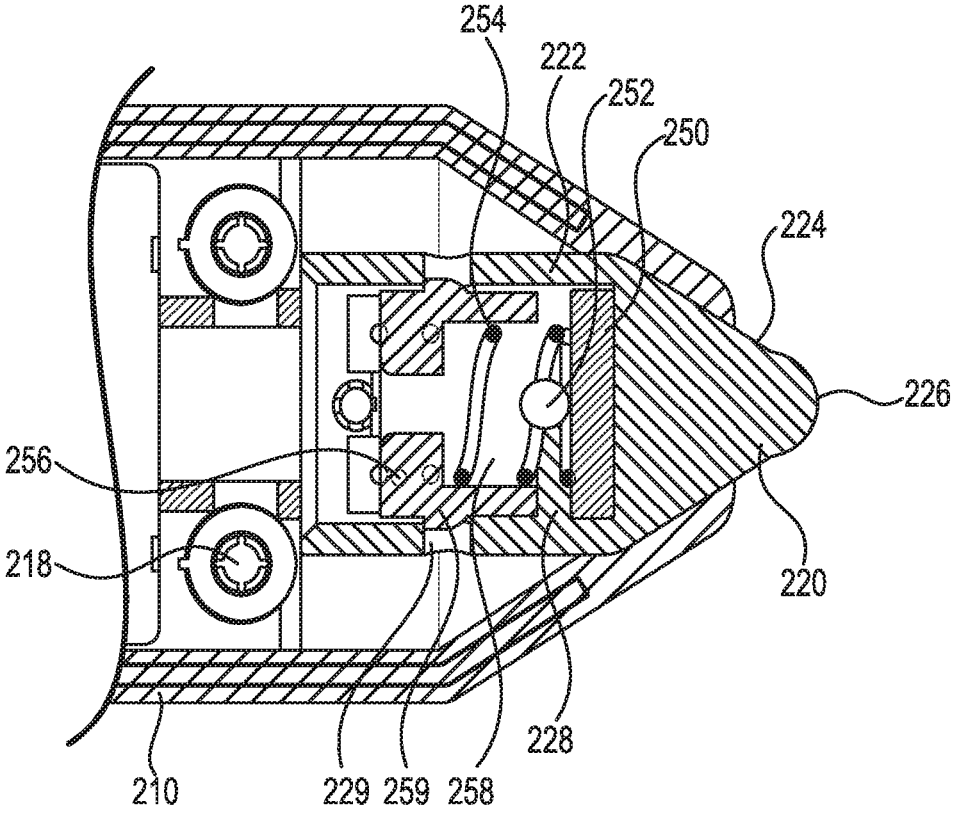
FIG. 2C is a cross sectional view of a portion of the heated pen of FIG. 2B, according to one or more embodiments.

FIG. 2C illustrates a cross sectional view of the heated tip 220. As described above with respect to heated tips 120, 320, and 420, the heated tip 220 may have cylindrical portion 222, a conical portion 224, and a rounded tip 226. The cylindrical portion 222 may have a cavity 228 configured to receive a heating element 250. The heating element 250 may be or include a ceramic PTC heating element, as described above, and may have a circular disk shape or other suitable shape. Each of the heated tip 220 and heating element 250 may be electrically coupled to the circuit board 240 and/or controller 242 via one or more leads or wires 249 in some embodiments, as shown in FIG. 2B. As additionally shown in FIGS. 2B and 2C, the heated tip 220 may house within the cavity 228 a temperature sensor 252, a spring 254, and a spring holder 256.

The temperature sensor 252 may be configured to sense a temperature at or near a surface of the heating element 250 in some embodiments. In other embodiments, the temperature sensor 252 may be configured to sense a temperature at or near a surface of the heated tip 220. The temperature sensor 252 may be a negative temperature coefficient device in some embodiments. In other embodiments, the temperature sensor 252 may use any suitable mechanism or device to detect or determine a temperature. The temperature sensor 252 may be in electrical communication with the circuit board 240 and/or controller 242 via one or more wires 249, as shown in FIG. 2B. The temperature sensor 252 may communicate a detected temperature of the heating element 250 and/or heated tip 220 to the controller 240, such that the controller 240 may adjust power supplied to the heating element in response. The temperature sensor 252 may be positioned on or near the heating element 250 in some embodiments. For example, as shown in FIG. 2C, the temperature sensor 252 may be positioned between the heating element 250 and spring holder 256 in some embodiments. In other embodiments, the temperature sensor 252 may be arranged in any suitable location.

Together, the spring 254 and spring holder 256 may operate to position the heating element 250 against or in thermal communication with the heated tip 220. In some embodiments, the spring 254 may be a coiled spring composed of metal or other suitable materials. As shown in FIG. 2C, the spring 254 may be arranged between the heating element 250 and spring holder 256. The spring 254 may be sized to be arranged within the cavity 228 of the heated tip 220 and/or within the spring holder 256. The spring holder 256 may be arranged such that the spring 254 is compressed or partially compressed between the spring holder and heating element 250. The spring holder 256 may be composed of plastic, metal or other suitable materials. The spring holder 256 may have any suitable size and shape, and in some embodiments, may be configured to be positioned within or partially within the cavity 228 of the heated tip 220. The spring holder 256 may generally have a cylindrical shape in some embodiments, corresponding with a cylindrically shaped cavity 228, for example. The spring holder 256 may have a cavity 258 configured to receive at least a portion of the spring 254. For example, the cavity 258 may be a cylindrically shaped opening sized to receive the coiled spring 254. In this way, the spring 254 may be positioned between an inner surface of the cavity 258 and the heating element 250. In other embodiments, the spring holder 256 may be a substantially solid component. The spring holder 256 may additionally have one or more notches 259 extending from an outer surface of the holder. The one or more notches 259 may correspond with one or more openings 229 in the heated tip 220, such as in a sidewall of the cylindrical portion 222. The notch(es) 259 and corresponding opening(s) 229 may operate in conjunction to maintain the spring holder 256 in a fixed position within the heated tip 220. In some embodiments, as shown in FIG. 2C, the one or more notches 259 may have a fin shape with a curved or angled side and a straight ledge side. In this way, the notch(es) 259 may be configured to slide over the opening(s) 229 when moved across them in one direction, such that the curved or angled side of the notch(es) moves over the opening(s). Likewise, the notch(es) 259 may be configured to maintain the spring holder 256 in a fixed position when moved across the opening(s) 229 in an opposing direction, such that the straight ledge side of the notch(es) catches on the opening(s). This may allow the spring 254 to be maintained in compression without dislodging the spring holder 256.

Figure 5:
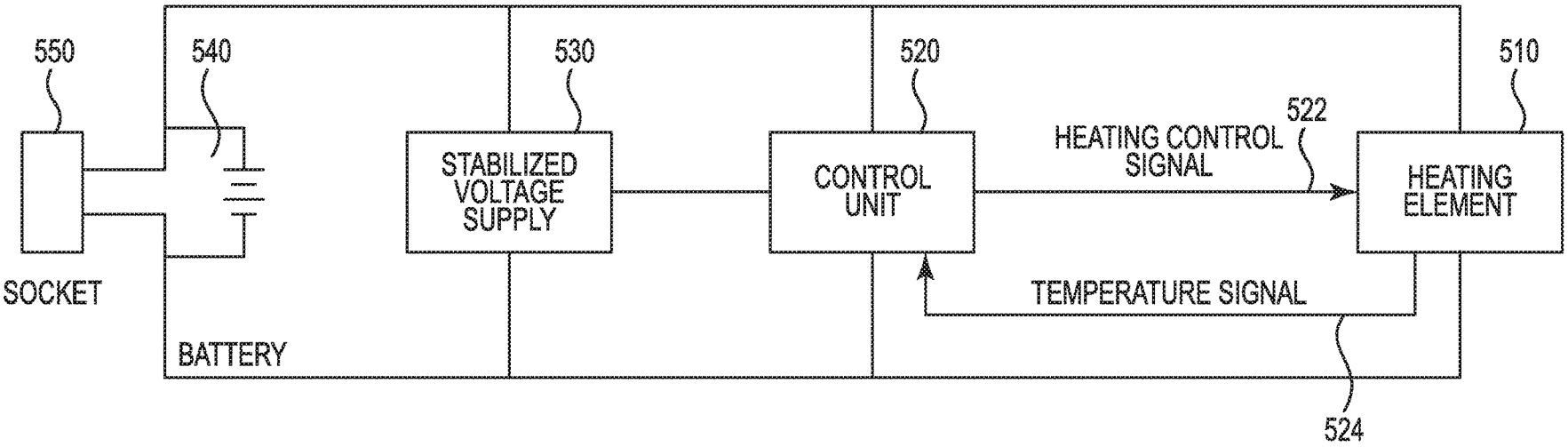
FIG. 5 is a schematic diagram of a circuit for a heated pen of the present disclosure, according to one or more embodiments.

Turning now to FIG. 5, a circuit diagram for a circuit 500 powering and/or controlling a heated pen of the present disclosure is shown. As shown, the circuit 500 may include a heating element 510 in electrical communication with a control unit 520, a stabilized voltage supply 530, a battery 540, and a socket 550. The heating element 510 may be configured to increase in temperature in response to receiving power from an energy source. The control unit 520 may be configured to direct or regulate energy from the battery 540 to the heating element 510. Additionally, the control unit 520 may be configured to send a heating control signal 522 to the heating element 510 and/or receive a temperature signal 5124 from the heating element 510. The control signal 522 may provide for heating the heating element 510 to a particular temperature and/or adjusting the temperature. The temperature signal 524 may be sent via a temperature sensor in some embodiments, and may provide current or recent temperature data for the heating element 510. In this way, the heating control signal 522 and temperature signal 524 may provide a continuous or substantially continuous feedback loop in order to maintain a desired or predetermined temperature or temperature range of the heating element. The stabilized voltage supply 530 may regulate voltage to the heating element 510 in some embodiments. The battery 540 may generally power the heating element 510. The battery 540 may be a lithium-ion battery in some embodiments. In other embodiments, the battery 540 may be any suitable battery or batteries. The socket 550 may provide a means for charging or recharging the battery 540. For example, the socket 550 may be or include a USB or mini USB socket configured to receive a USB or mini USB plug coupled to the battery. In other embodiments, the circuit 500 may include additional or alternative components.

Figure 6A:
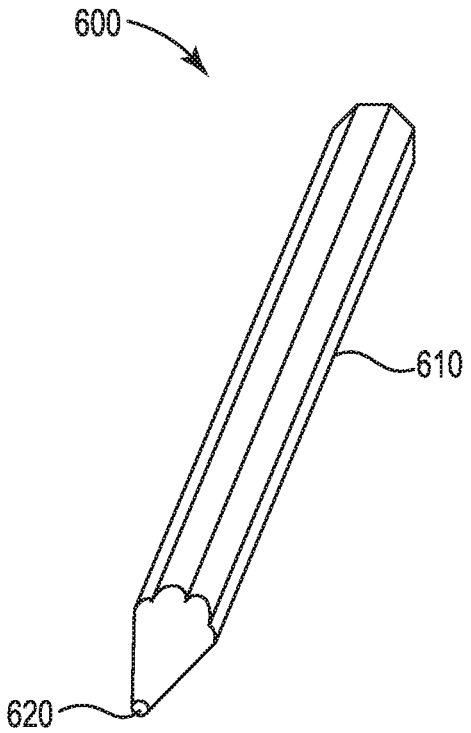
FIG. 6A is a perspective view of a heated pen of the present disclosure, according to one or more embodiments.
Figure 6B:
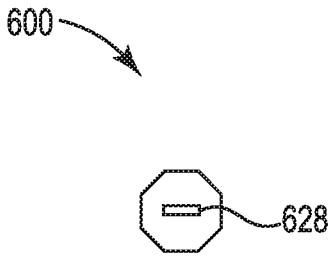
FIG. 6B is an end view of the heated pen of FIG. 6A, according to one or more embodiments.
Figure 6C:
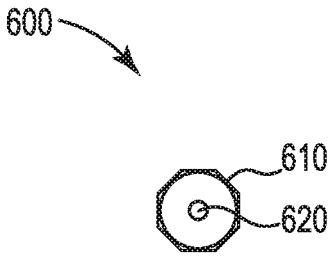
FIG. 6C is an opposing end view of the heated pen of FIG. 6A, according to one or more embodiments.

A heated pen of the present disclosure may have various design elements, features, and components. For example, FIGS. 6A-6C illustrate an additional embodiment of a heated pen 600 of the present disclosure. As shown, the heated pen 600 may have a body 610, a heated tip 620, and a charging port 648. As may be appreciated from FIGS. 6A-6C, in some embodiments, the heated pen 600 may generally be configured to appear similar to a pencil or crayon, for example. As shown for example in FIGS. 6A-6C, the heated body 610 may have a hexagonal cross sectional shape for example, so as to appear like a pencil or pen. U.S. Pat. No. 8,662,893, titled "Thermochromatic Inks, Printing Methods and Kits," and filed Feb. 22, 2011, is hereby incorporated herein by reference in its entirety. FIGS. 16-29 of U.S. Pat. No. 8,662,893 illustrate additional embodiments of heated pens having various elements, features, and components. A heated pen of the present disclosure may have any of the elements, features, or components illustrated in FIGS. 16-29 of U.S. Pat. No. 8,662,893.

As described above, a heated pen of the present disclosure may generally be used to draw on, write on, color on, or otherwise interact with a surface. In some embodiments, the surface may be treated with one or more thermochromatic inks or other thermochromatic components. For example, in some embodiments, the surface may be a sheet of paper or other substrate treated with thermochromatic ink.

The thermochromatic inks of the present disclosure may be any suitable thermochromatic ink, including inks that include liquid crystals and/or leuco dyes, for example. A thermochromatic ink of the present disclosure may have a transition temperature or temperature range, defining the temperature(s) at which the thermochromatic ink actives and changes to a different color. The thermochromatic ink may change from any suitable first color to any suitable second color upon heat activation. In some embodiments, the thermochromatic ink may change from any suitable first level of opaqueness to any suitable second level of opaqueness upon heat activation. In some embodiments, the thermochromatic ink may begin or may change to a clear layer, for example. Thermochromatic inks of the present disclosure may have any suitable transition temperature or range. For example, the a transition temperature may be between −10 and 100 degrees Celsius in some embodiments. Further a transition range may be a wide or narrow range. For example, transition ranges for thermochromatic inks of the present disclosure may include anywhere from 0.5 to 40 degrees Celsius in some embodiments. One formulation, for example, can have a transition point of about 16° C. to about 31° C., and another can have a transition point of about 45° C. to about 60° C. In some examples, the one or more ink formulations used may be those available from Pilot Corporation or Sawgrass Corporation.

In some embodiments, more than one thermochromatic ink may be used in a single ink formulation, with one or more temperature transition points and one or more colors or color combinations. For example, one or more thermochromatic ink formulations may be layered on the substrate or surface. In various examples, each of the ink formulations may have different thermal qualities with varying transition points. One of the benefits of using such inks in a combination is that multiple stages of heating can be used to reveal different layers of images, colors, or other types of prints.

A heated pen of the present disclosure may generally be configured to activate the one or more thermochromatic inks. When heat from the heated pen is applied to the one or more inks, a writing or drawing can be created by activating or transitioning the thermochromatic ink(s) wherever the heated pen touches the surface or substrate. Printed images, colors, or other images may be revealed beneath the one or more thermochromatic inks. There are a variety of methods by which the thermochromatic inks may be applied to the surface or substrate, including, for example, gravure printing, flexo-coating, or other suitable methods of coating and/or printing. The surface or substrate on which one or more thermochromatic inks is printed or applied may be a paper or plastic substrate, in some embodiments.

In some embodiments, the substrate can be any suitable material that can be in one or more layers and that can include one or more layers of thermochromatic inks and one or more layers of non-thermochromatic inks. In embodiments the substrate may be clear or translucent. In some embodiments, the substrate can be a paper or other material that is not necessarily clear or translucent. In some cases, it can be preferable to have the printed image on a white or other color background, rather than a clear background. With the application of cooling or heating, the thermochromatic inks may turn transparent or translucent to reveal images or colors, or the thermochromatic inks can turn different colors. With combinations of multiple thermochromatic inks, combinations of transition points, transparency, and different colors, a wide variety of different patterns can be created as a result of the heating or cooling treatment of the substrate. By combining inks with different transitional temperatures, different temperatures of heating and cooling can produce different colors.

In some embodiments, a device for holding or positioning a thermochromatic ink-treated substrate may be provided. The device may generally be configured to provide a backing or work surface for the substrate, against which a user may write, draw, or color. Additionally, the device may be configured to position the substrate and/or minimize movement of the substrate during use. In some embodiments, the device may have a backlight or other light for illuminating the substrate. The device may be a children's toy in some embodiments. In other embodiments, the device may be a device configured for adults, such as an art device.

Figure 7:
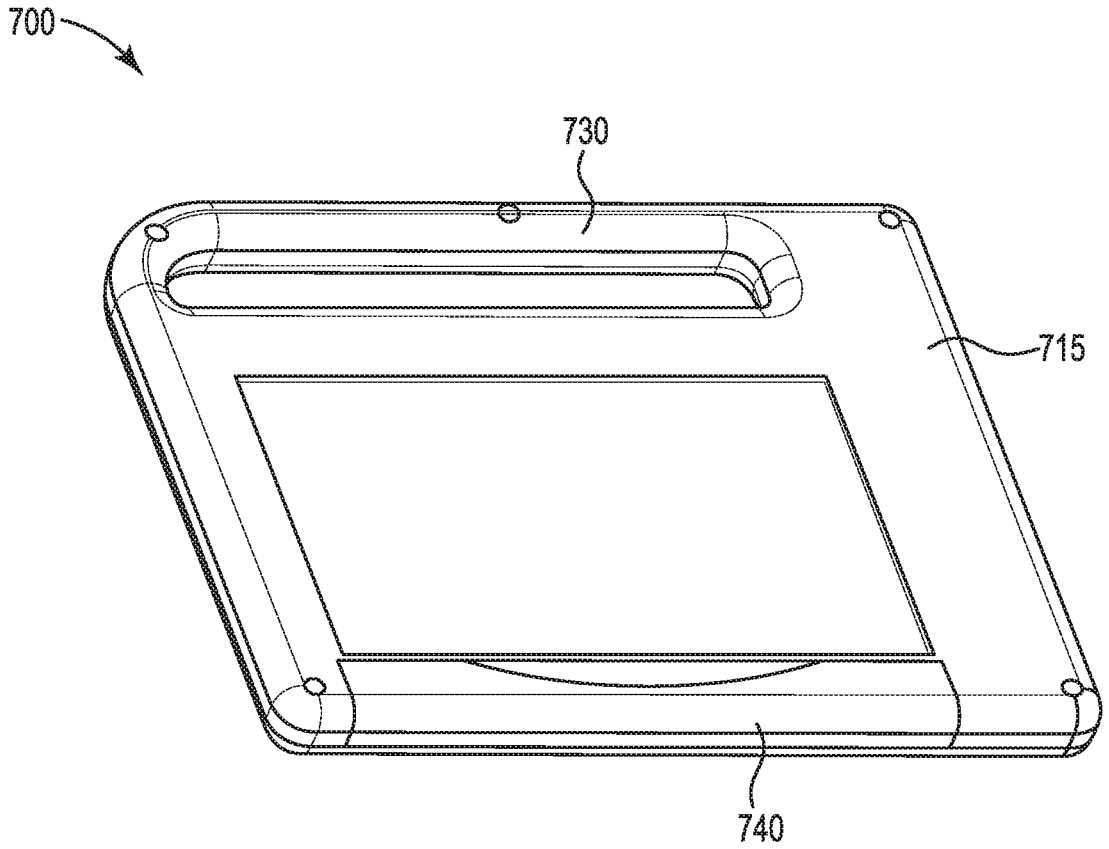
FIG. 7 is a device of the present disclosure for holding a substrate, according to one or more embodiments.

Turning now to FIGS. 7-8, a substrate holding device of the present disclosure may have a work surface, a handle, a drawer, a holder configured to receive a writing device, a switch, one or more indicator lights, a stand, a frame, an external light, and/or other elements.

Figure 8A:
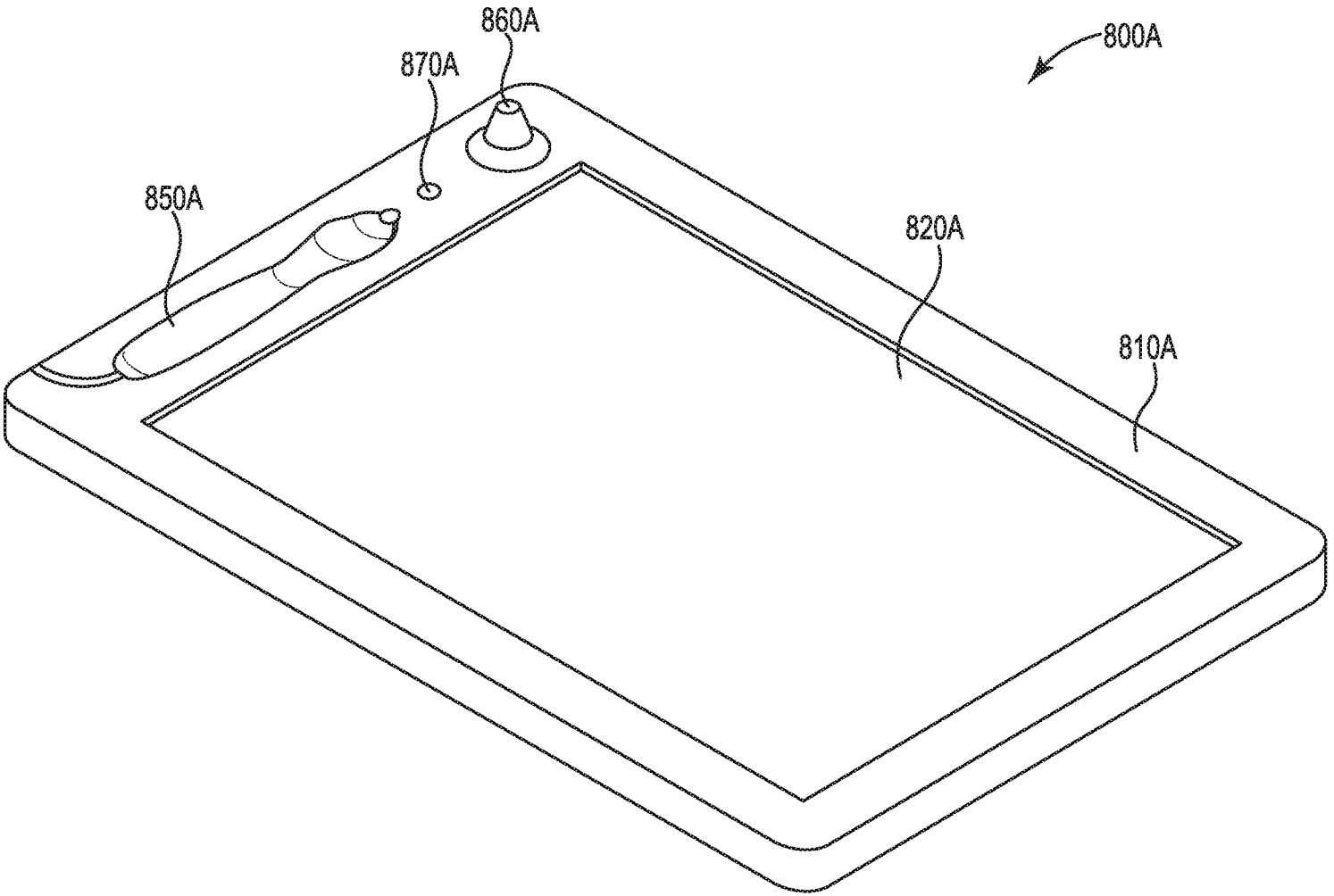
FIG. 8A is a device of the present disclosure for holding a substrate, according to one or more embodiments.
Figure 8B:
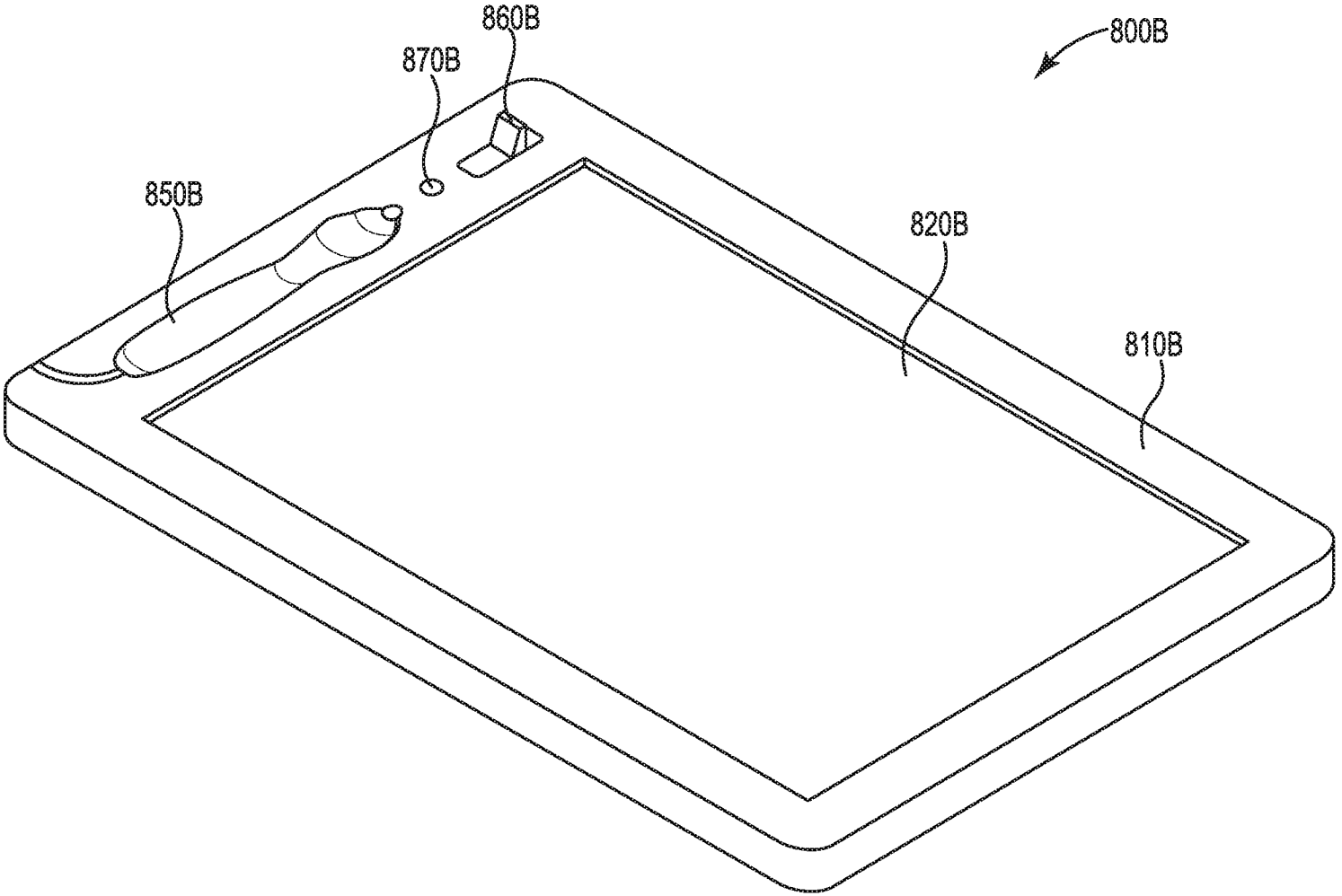
FIG. 8B is another device of the present disclosure for holding a substrate, according to one or more embodiments.
Figure 8C:
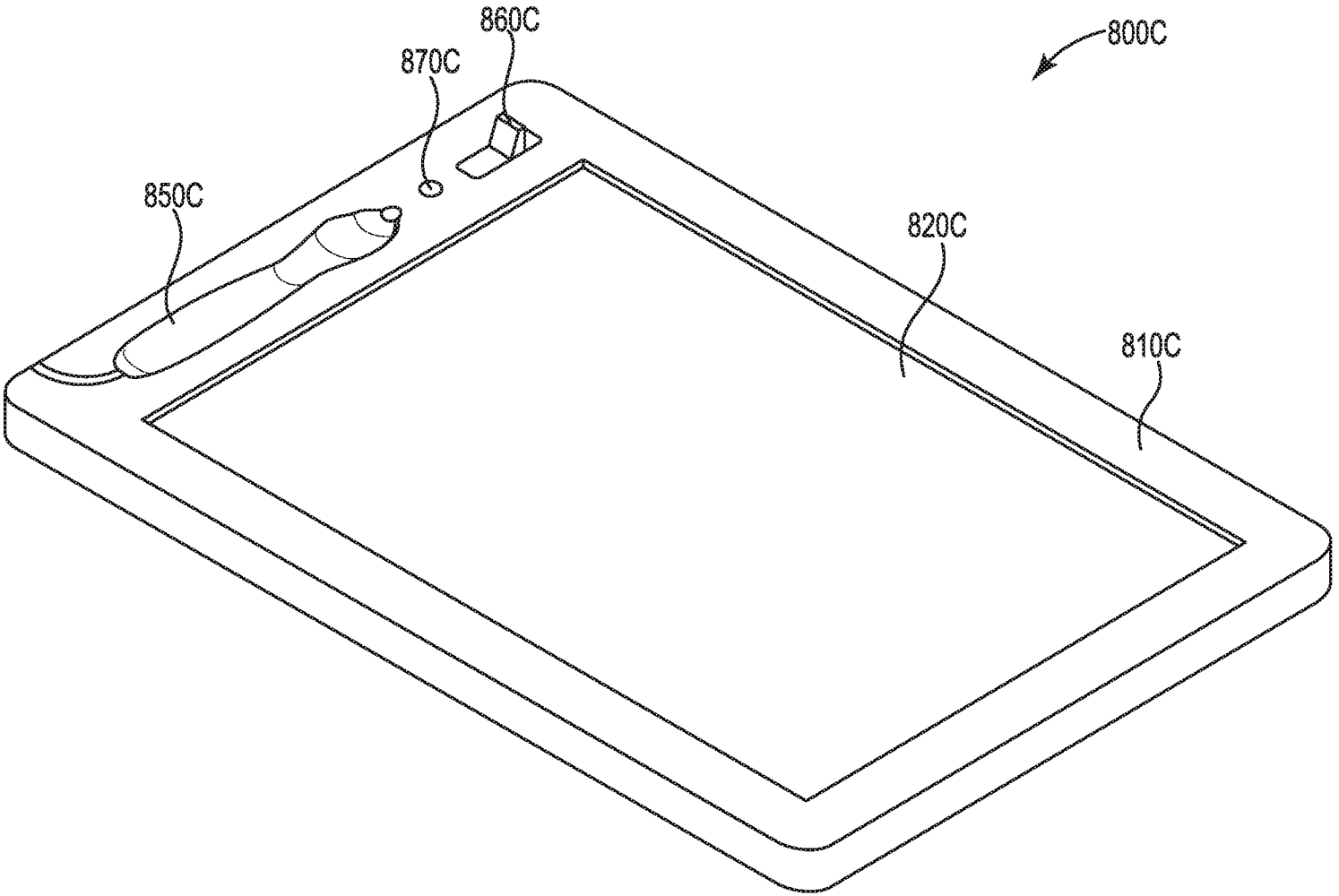
FIG. 8C is another device of the present disclosure for holding a substrate, according to one or more embodiments.
Figure 8D:
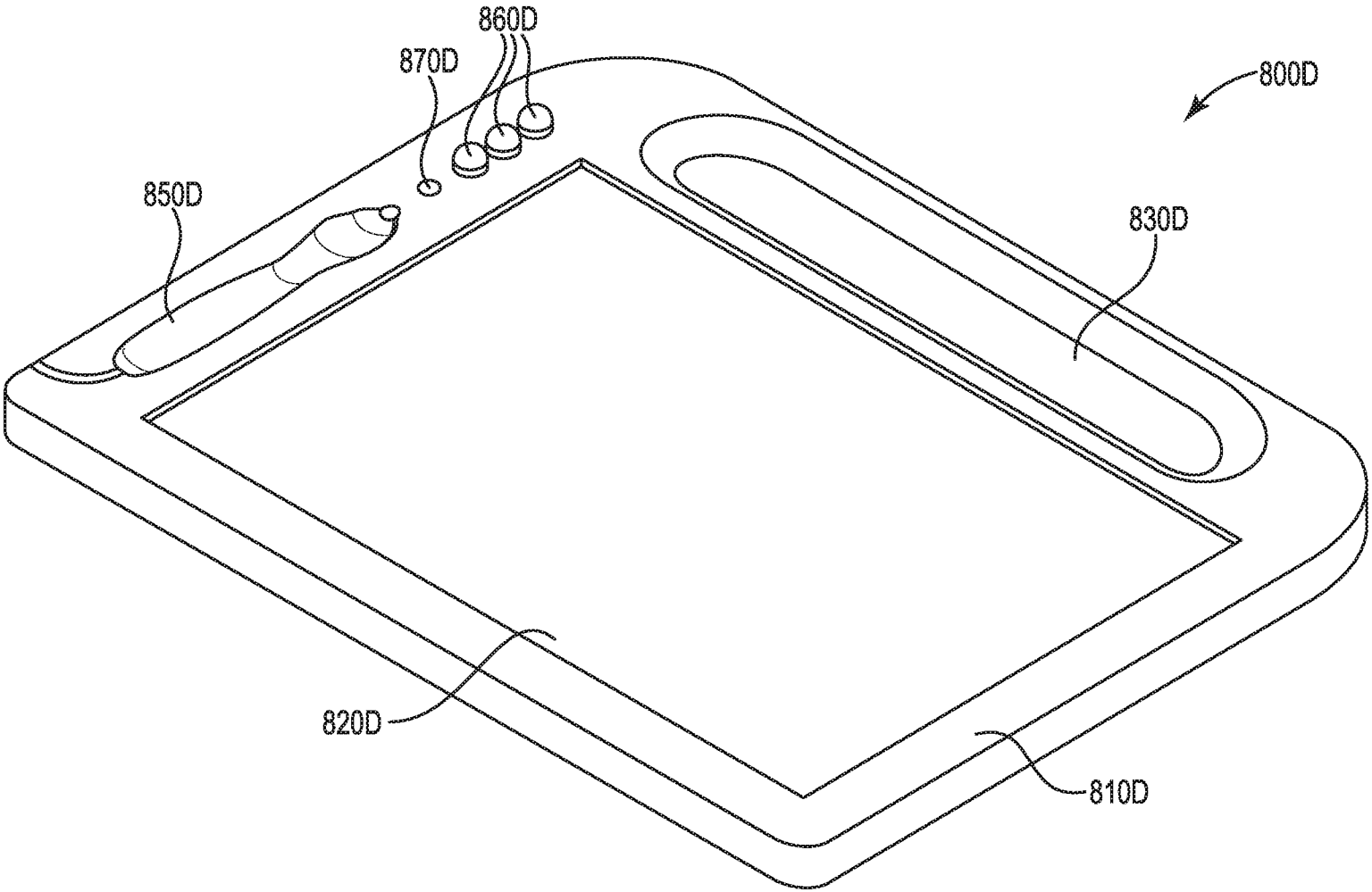
FIG. 8D is another device of the present disclosure for holding a substrate, according to one or more embodiments.
Figure 8E:
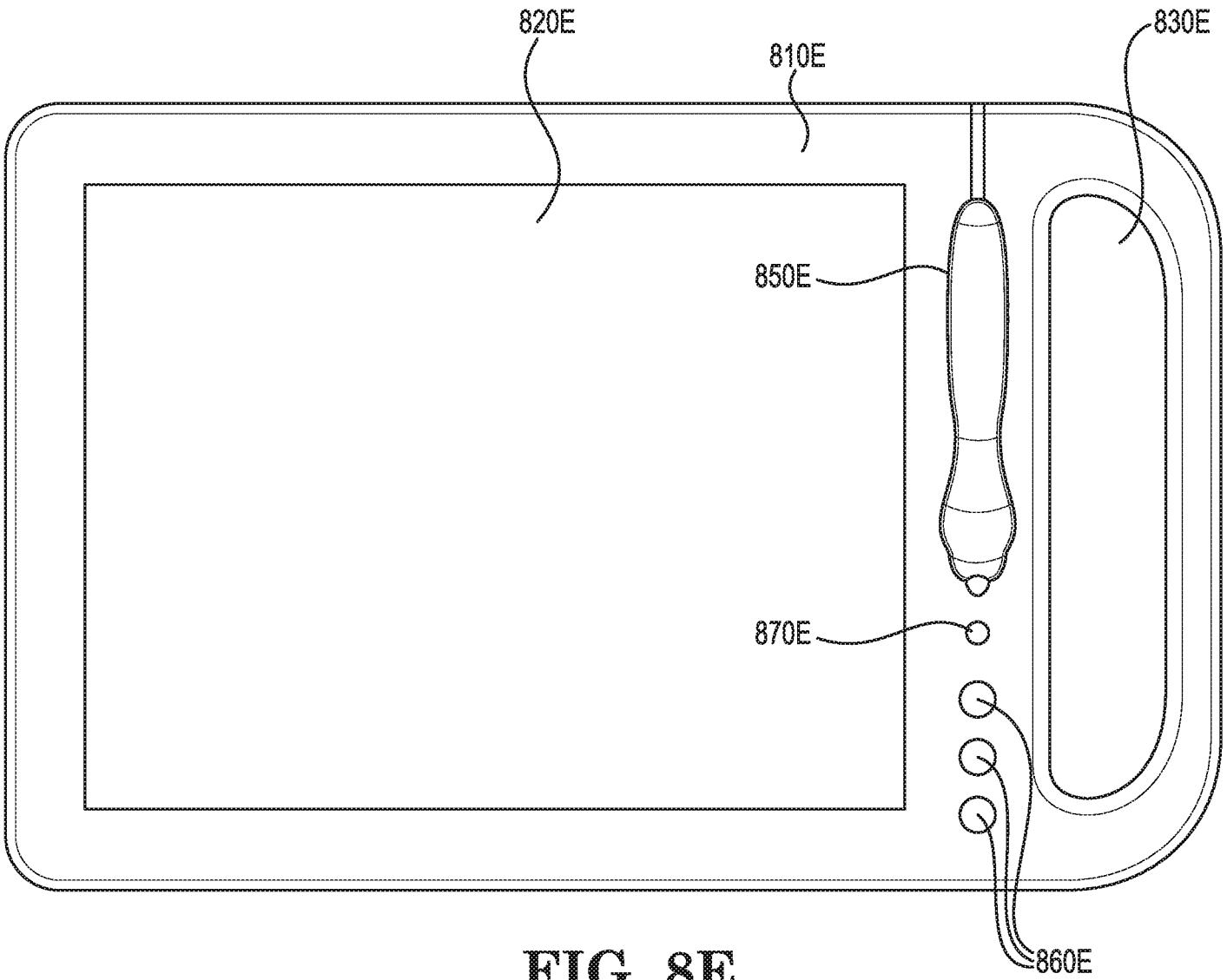
FIG. 8E is another device of the present disclosure for holding a substrate, according to one or more embodiments.
Figure 8F:
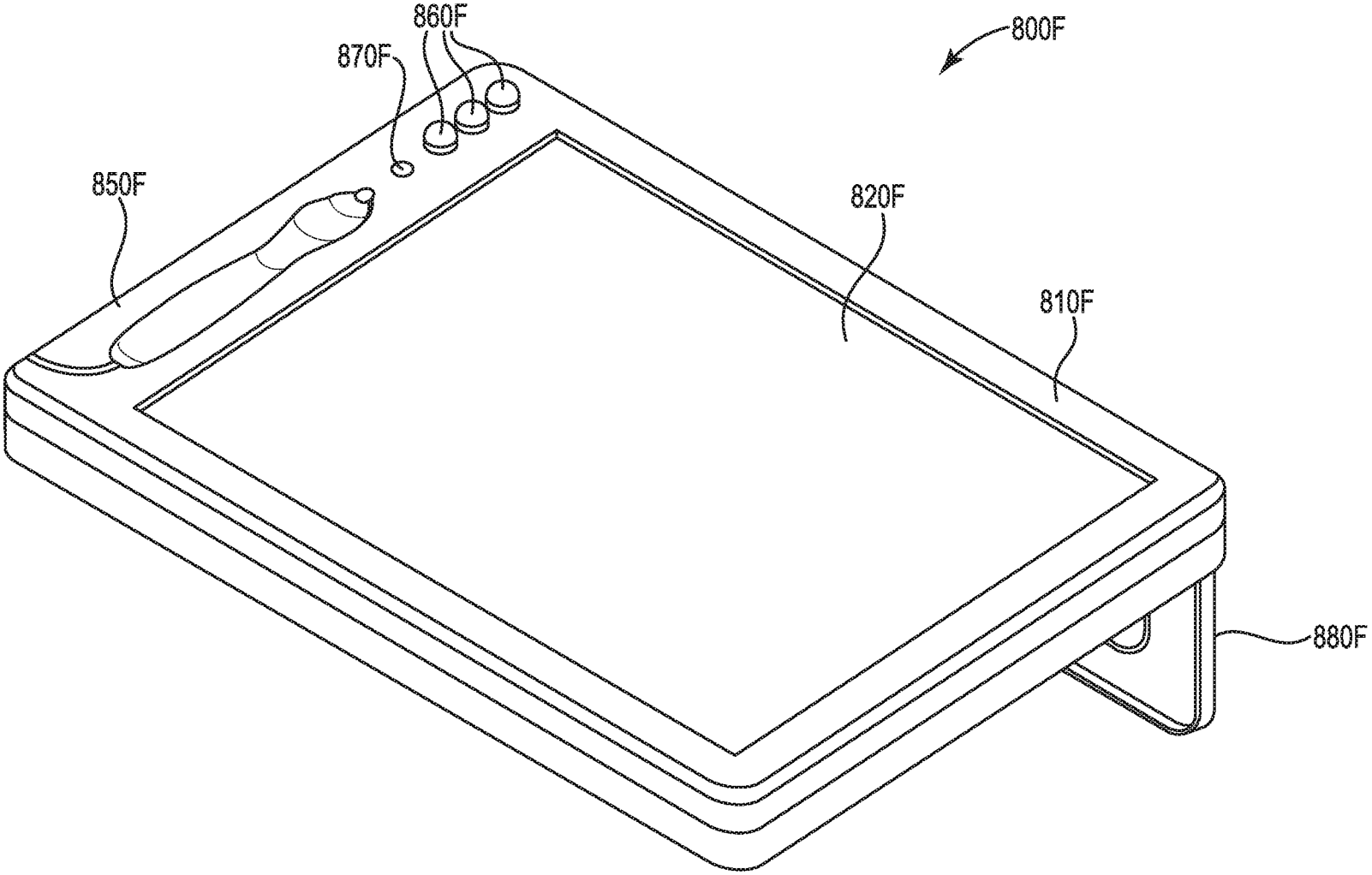
FIG. 8F is another device of the present disclosure for holding a substrate, according to one or more embodiments.
Figure 8G:
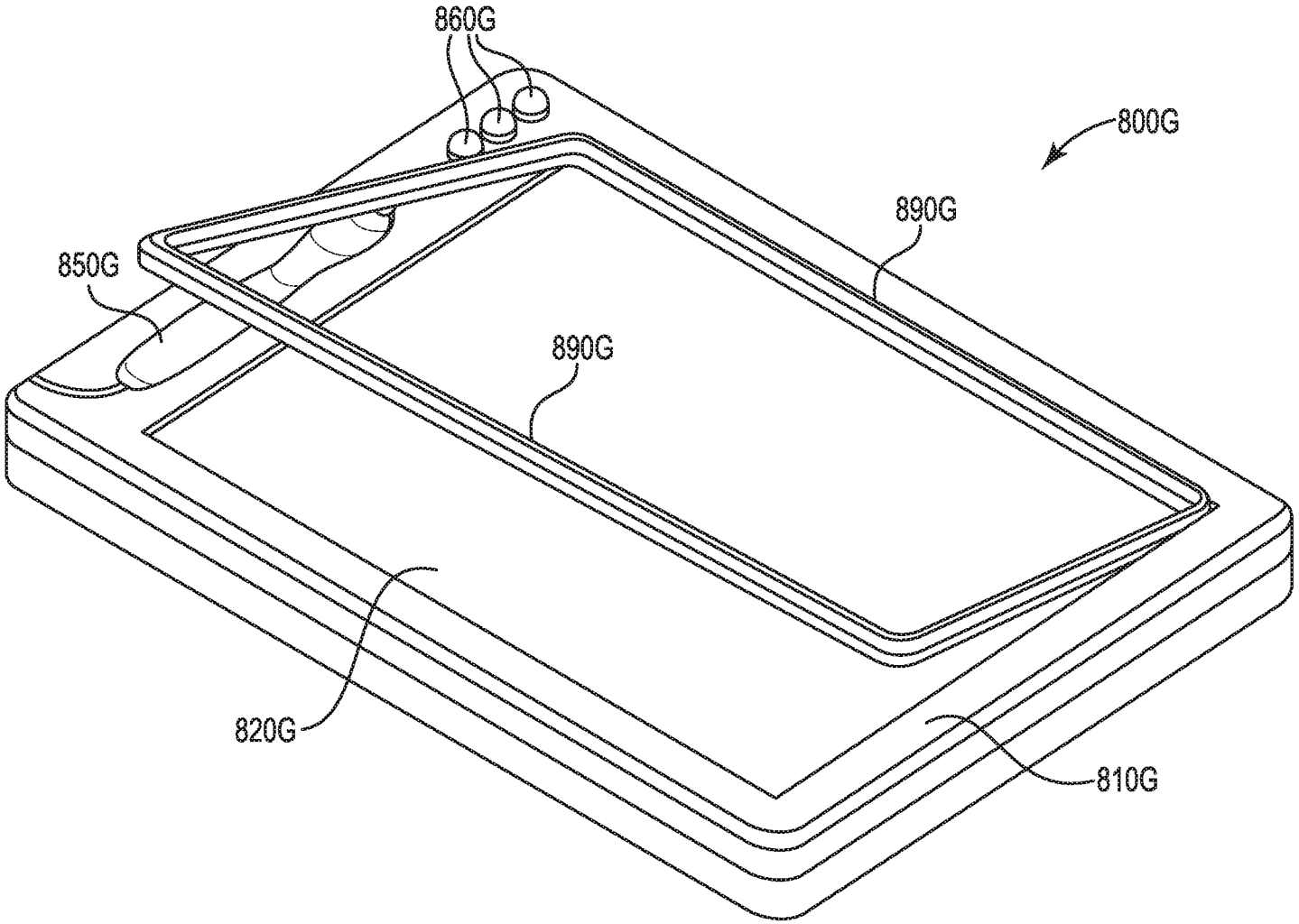
FIG. 8G is another device of the present disclosure for holding a substrate, according to one or more embodiments.
Figure 8H:
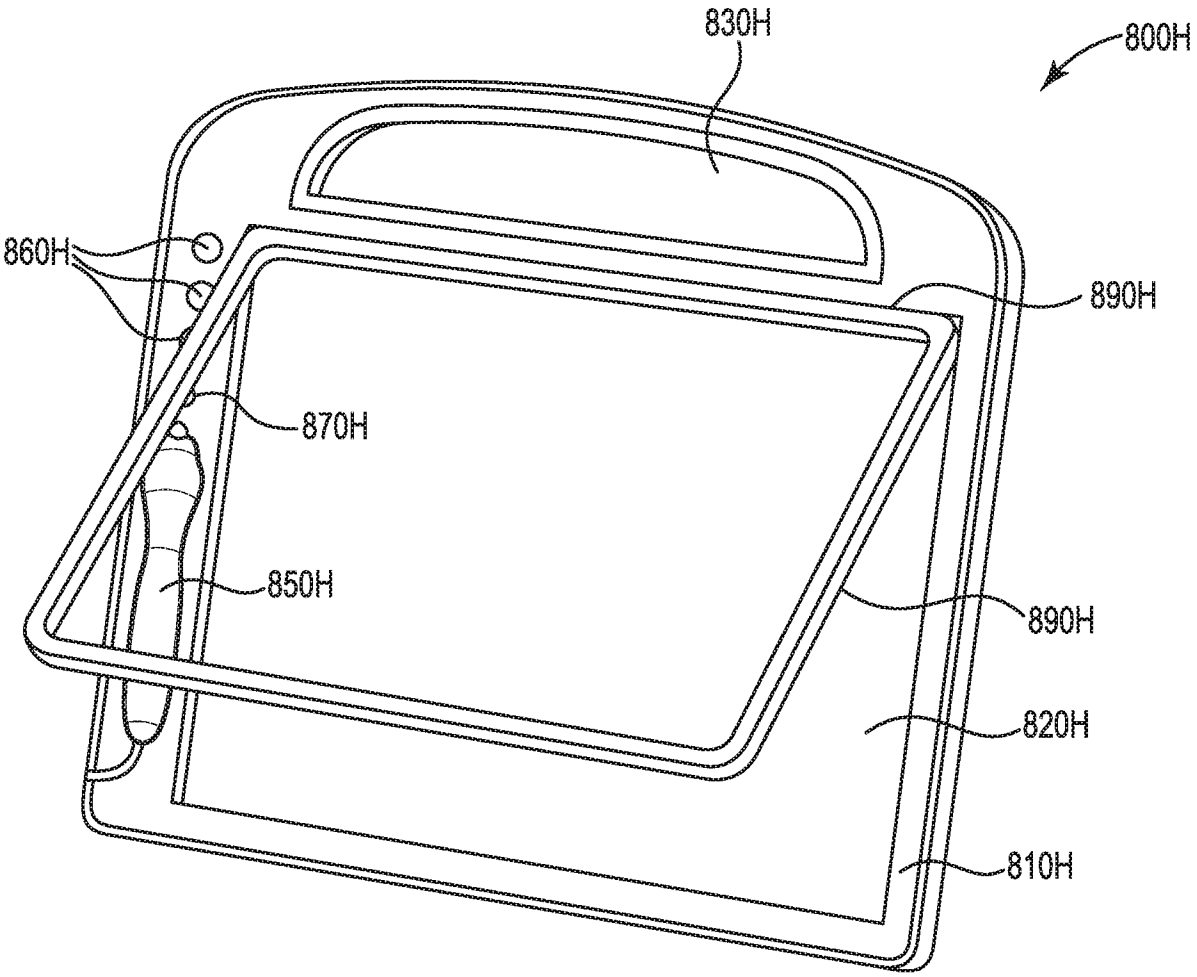
FIG. 8H is another device of the present disclosure for holding a substrate, according to one or more embodiments.
Figure 8I:
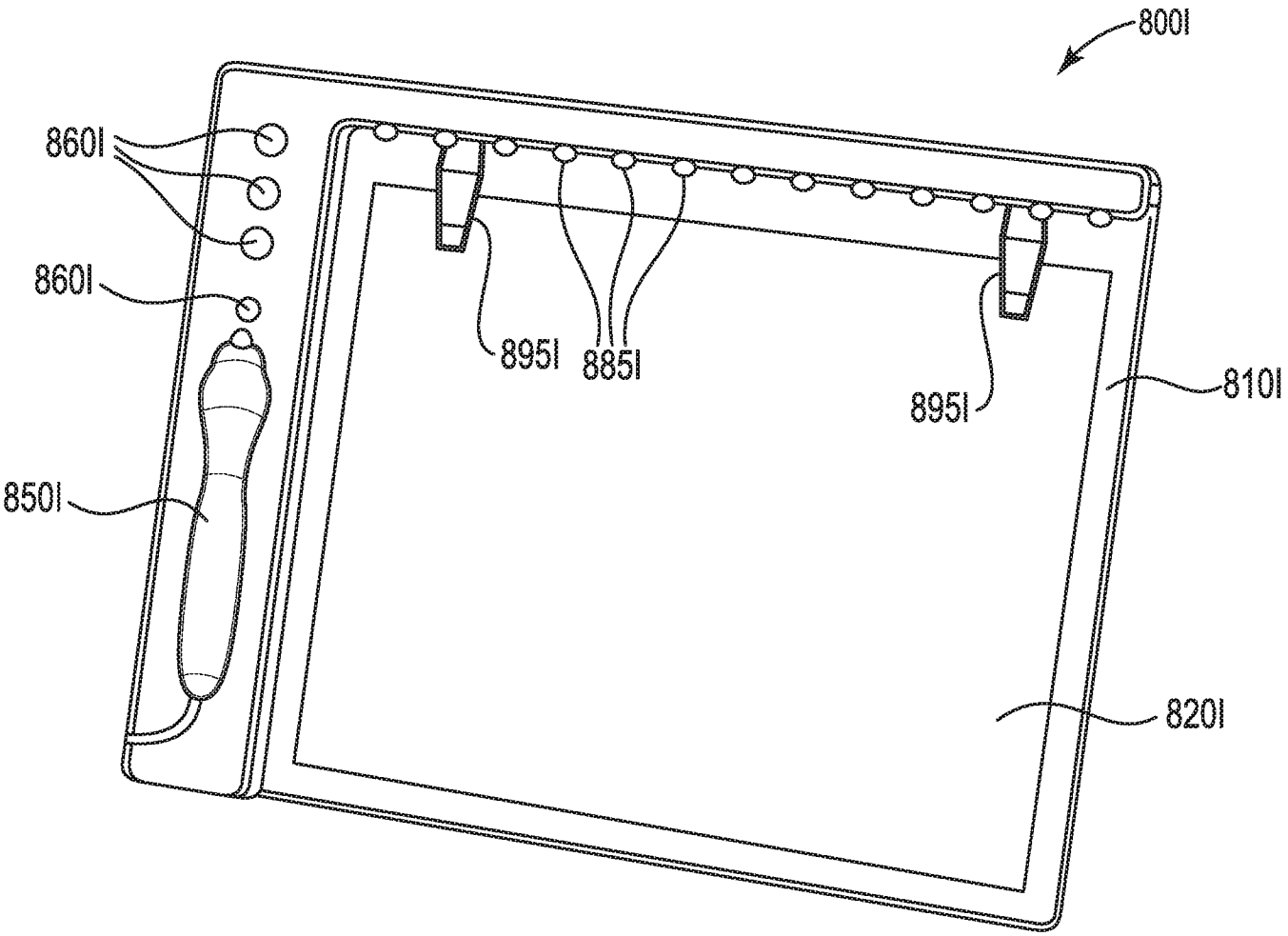
FIG. 8I is another device of the present disclosure for holding a substrate, according to one or more embodiments.
Figure 8J:
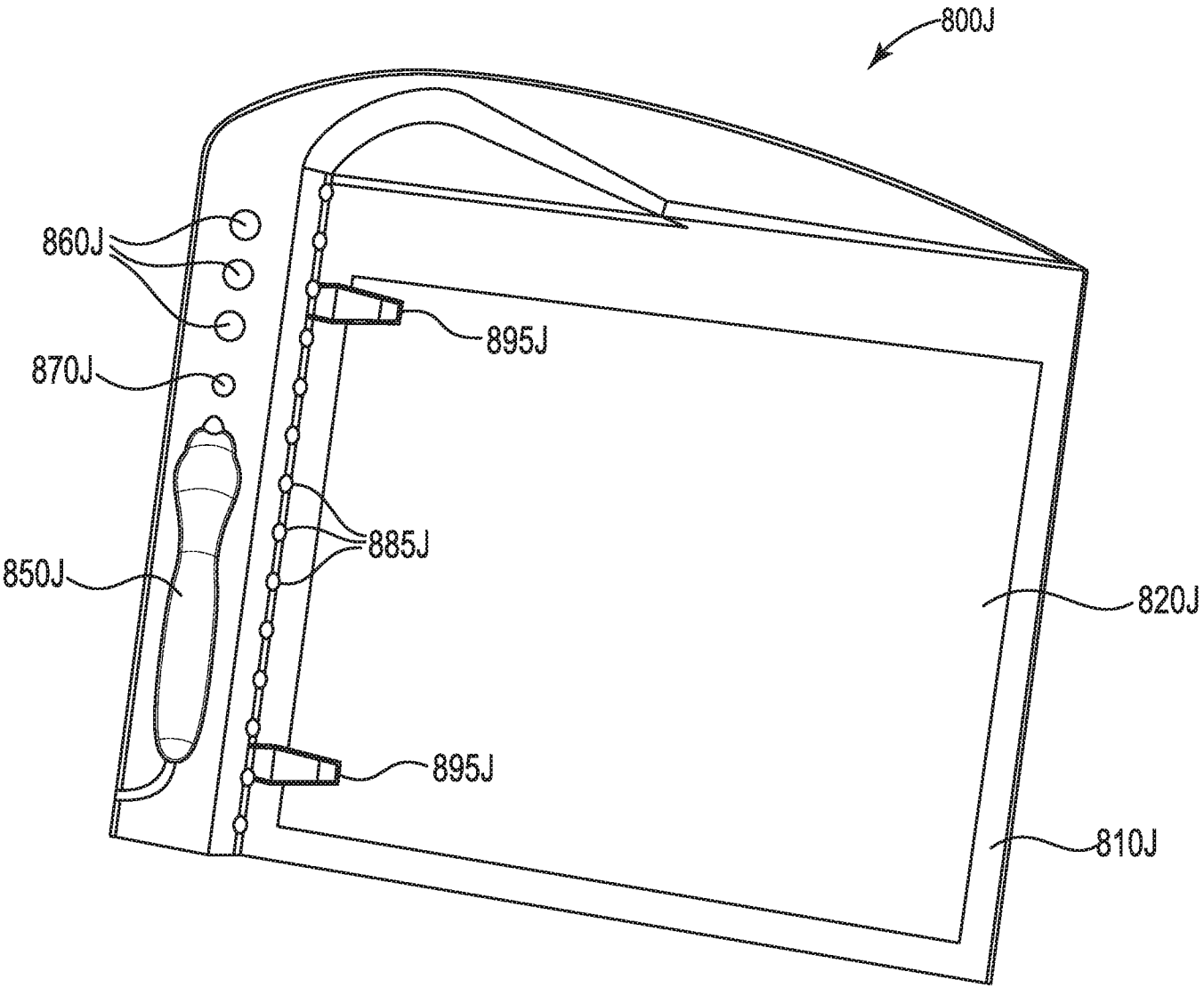
FIG. 8J is another device of the present disclosure for holding a substrate, according to one or more embodiments.

For example, FIGS. 8A-8J illustrate some embodiments of substrate holding devices 800A-800J of the present disclosure. While FIGS. 8A-8J are described generally below, they are described in more detail in U.S. Pat. No. 8,662,893, previously incorporated by reference in this disclosure. As shown for example in FIG. 8A, the device 800A may have a work surface 820A arranged on a front portion 810A. In some embodiments, the device 800A may have a holder 850A configured to receive a writing device, such as a heated pen of the present disclosure. The holder 850A may be a cutout or recess in the front portion 810A of the device 800A. The cutout or recess may have a shape similar to that of the writing device. In some embodiments, the device 800A may additionally have a switch 860A and one or more indicator lights 870A. The switch 860A may be configured to turn on a backlight behind the work surface 820, for example. The indicator light 870A may be configured to indicate when the backlight is on, when the heated pen has reached a particular temperature, and/or other information. As may be appreciated from FIGS. 8A-8J, the device 800A-J may have various additional or alternative features, elements, and components. In some embodiments, as shown for example in FIG. 8C, the device 800C may have a plurality of switches or buttons 860C for controlling various elements. For example, the switches 860C may control the color of a backlight provided behind the work surface 820C. As may be appreciated from the figures, a handle may be provided at various locations of the device, as shown for example in FIGS. 8D and 8E. As shown in FIG. 8F, the device 800F may have a stand 880F at one end configured to position the work surface 820F at an angle. In some embodiments, the stand 880F may additionally serve as a handle for the device 800F. As shown in FIGS. 8G and 8H, the device 800G, 800H may have a frame 890G, 890H in some embodiments. The frame 890G, 890H may be configured to hold a substrate in place on the work surface 820G, 820H during use. The frame 890G, 890H may generally be configured to be positioned around the edges of the work surface 820G, 820H and may have a size and shape similar to that of the work surface. The frame 890G, 890H may be removable in some embodiments. In other embodiments, the frame 890G, 890H may be coupled to the device 800G, 800H via one or more hinges or other devices. As shown in FIGS. 8I and 8J, the device 800I, 800J may have one or more external clips 895I, 895J in some embodiments. The one or more clips 895I, 895J may be configured to hold a substrate in position on the work surface 820I, 820J while in use. As additionally shown in FIGS. 8I and 8J, the device 800I, 800J may have one or more external lights 885I, 885J in some embodiments. The one or more external lights 885I, 885J may be configured to illuminate the work surface 820I, 820J.

FIG. 7 illustrates another example of a substrate holding device 700. FIG. 7 illustrates a back portion 715, which may be arranged opposite a front portion of the device 700, on which a work surface may be arranged. As shown, the device 700 may have a handle 730 and a drawer 740. The device 700 may be constructed of plastic or any other suitable material or materials. The device 700 may have any suitable shape, and in some embodiments may have a rectangular shape, as shown in FIG. 7. The device 700 may have any suitable size. For example, in some embodiments, the device 700 may have a width of between 3 and 12 inches, a length of between 6 and 24 inches, and a thickness of between 0.25 and 6 inches. In other embodiments, the device 700 may have any suitable size.

The handle 730 may provide a means for carrying the device 700. The handle may generally have any suitable shape and size, and may have ergonomic features in some embodiments. The handle 730 may be provided at any suitable location on the device 700. For example, the handle 730 may be arranged on a side edge of the device 700.

The drawer 740 may be configured for storing materials, such as one or more substrates having thermochromatic ink. The drawer 740 may allow a user to store excess blank or unused substrates and/or substrates that have already been activated or partially activated. As shown, the drawer may be accessible from a side of the device 700. The drawer 740 may generally be arranged such that the stored materials may be positioned behind or beneath the work surface in some embodiments. The drawer may slide outward from the device 700. In some embodiments, the drawer 740 may have a cover that may snap or lock into place. For example, the cover may be pulled down in order to access and pull out the drawer 740. In other embodiments, the drawer 740 may have other locking mechanisms, so as to help prevent the drawer from sliding open while a user draws over the work surface. It is appreciated that any substrate holding device of the present disclosure may have a drawer configured for storing materials. In still further embodiments, rather than a pull out drawer, a substrate holding device of the present disclosure may have an access panel, which may slide or flip open, for example, to provide access to a storage cavity configured to store substrates and/or other materials.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A device for activating thermochromatic ink, the device comprising:

a drawing tip comprising a conductive body having a substantially conical portion, a substantially rounded point, and a cavity, and the rounded point is at an end of the conical portion;

a heating element arranged within the cavity, the heating element communicably coupled to the drawing tip and configured to connect to a power source to heat the drawing tip;

a controller configured to direct power from the power source to the heating element; and a temperature sensor communicably coupled to the controller, the temperature sensor configured to sense a temperature of the drawing tip, the heating element, or both and communicate the sensed temperature to the controller.

2. The device of claim 1, wherein the device comprises a lithium-ion battery to provide the power source to heat the drawing tip.

3. The device of claim 2, wherein the lithium-ion battery is rechargeable.

4. The device of claim 3, wherein the device further comprising a charging port for recharging the lithium-ion battery coupled to the charging port.

5. The device of claim 1, further comprising a regulator for regulating power from the power source to the heating element.

6. The device of claim 1, wherein the heating element is configured to heat the drawing tip to a temperature between 30-70 degrees Celsius.

7. A thermochromatic drawing system, comprising:

a work surface configured to provide a support for a substrate, wherein the substrate is treated with a thermochromatic ink; and a device for activating thermochromatic ink, the device comprising:

a drawing tip comprising a conductive body having a cylindrical portion, a substantially conical portion, a substantially rounded point, and a cavity, wherein the cavity is arranged at least partially within the cylindrical portion, the rounded point is at an end of the conical portion;

a heating element arranged within the cavity, the heating element comprising a positive temperature coefficient (PTC) heating element, the heating element communicably coupled to the drawing tip and configured to connect to a power source to heat the drawing tip; and a coiled spring and spring holder, the coiled spring held within the cavity between the heating element and the spring holder, the spring and spring holder providing a retention force to hold the heating element against the drawing tip.

8. The system of claim 7, further comprising at least one of a frame and a clip for holding the substrate against the work surface.

9. The system of claim 7, and further comprising a carrying handle for the work surface.

10. The system of claim 7, wherein the power source comprises a lithium-ion battery.

11. The system of claim 10, wherein the lithium-ion battery is rechargeable.

12. The system of claim 7, and further comprising a light for the work surface.

13. The system of claim 7, and further comprising a storage unit for storing the substrate.

14. The system of claim 7, wherein the substrate is a sheet of paper treated with one or more thermochromatic inks.

15. A device for activating thermochromatic ink, the device comprising:

a drawing tip comprising a conductive body including a substantially cylindrical portion, a substantially conical portion, a substantially rounded point, and a cavity, wherein the cavity is arranged within the cylindrical portion, the conical portion, or both, and the rounded point is at an end of the conical portion;

a heating element arranged within the cavity, the heating element communicably coupled to the drawing tip and configured to connect to a power source to heat the drawing tip; and a coiled spring and spring holder, the spring held within the cavity between the heating element and the spring holder, the coiled spring and spring holder providing a retention force to hold the heating element against the drawing tip.

16. The device of claim 15, wherein the power source comprises a lithium-ion battery.

17. The device of claim 15, further comprising:

a controller directing power from the power source to the heating element; and a temperature sensor communicably coupled to the controller, the temperature sensor configured to sense a temperature of the drawing tip, the heating element, or both and communicate the sensed temperature to the controller.

18. The system of claim 7, further comprising a controller configured to direct power from the power source to the heating element.

19. The system of claim 18, further comprising a temperature sensor communicably coupled to the controller, the temperature sensor configured to sense a temperature of the drawing tip, the heating element, or both and communicate the sensed temperature to the controller.

20. The device of claim 1 wherein the device further comprises a non-conductive housing having an elongate length extending between a first end and a second end, and the second end of the non-conductive housing having an opening, and the conductive body having a length that extends along the non-conductive housing and through the opening to expose the rounded point of the drawing tip.

21. The device of claim 20 wherein the non-conductive housing has a conical shaped portion at the second end and the conical portion of the conductive body of the drawing tip extends along the conical shaped portion of the non-conductive housing.

22. The device of claim 1 wherein the conductive body includes a cylindrical portion having the cavity disposed therein and the conical portion of the conductive body is located between the cylindrical portion and the rounded point.

23. The device of claim 1 wherein the conductive body includes a cylindrical portion having the cavity disposed therein and the conical portion is located between the cavity and the rounded point.

* * * * *